US009302150B2

(12) United States Patent
Tsuzuki

(10) Patent No.: US 9,302,150 B2
(45) Date of Patent: Apr. 5, 2016

(54) TRAINING APPARATUS

(71) Applicant: CLUBCREATE CO., LTD., Koto-ku, Tokyo (JP)

(72) Inventor: Takeo Tsuzuki, Tokyo (JP)

(73) Assignee: Clubcreate Co., Ltd., Tokyo (JP)

( * ) Notice: Subject to any disclaimer, the term of this patent is extended or adjusted under 35 U.S.C. 154(b) by 0 days.

(21) Appl. No.: 14/407,303

(22) PCT Filed: Jun. 11, 2013

(86) PCT No.: PCT/JP2013/066124
§ 371 (c)(1),
(2) Date: Dec. 11, 2014

(87) PCT Pub. No.: WO2013/187421
PCT Pub. Date: Dec. 9, 2013

(65) Prior Publication Data

US 2015/0182791 A1 Jul. 2, 2015

(30) Foreign Application Priority Data

Jun. 15, 2012 (JP) ..... 2012-136449

(51) Int. Cl.
*A63B 21/00* (2006.01)
*A63B 71/00* (2006.01)
(Continued)

(52) U.S. Cl.
CPC ..... *A63B 23/0211* (2013.01); *A63B 21/023* (2013.01); *A63B 21/0428* (2013.01);
(Continued)

(58) Field of Classification Search
CPC ..... A63B 21/00; A63B 21/02; A63B 21/04; A63B 21/0407; A63B 21/0442; A63B 21/055; A63B 21/0552; A63B 23/00; A63B 23/02; A63B 23/0211; A63B 23/0216; A63B 23/0222
USPC ..... 482/92, 110, 133, 135–137, 139, 148
See application file for complete search history.

(56) References Cited

U.S. PATENT DOCUMENTS 3,709,216 A * 1/1973 Hilyard ..... A61H 1/0218 606/237
4,026,279 A * 5/1977 Simjian ..... A61H 15/00 482/147

(Continued)

FOREIGN PATENT DOCUMENTS

JP 49-127096 U 2/1948
JP 64-083272 A 3/1989

(Continued)

*Primary Examiner* — Loan H Thanh
*Assistant Examiner* — Garrett Atkinson
(74) *Attorney, Agent, or Firm* — Carrier Blackman & Associates, P.C.; William D. Blackman; Joseph P. Carrier

(57) ABSTRACT

A training apparatus includes: a rotation center to be substantially matched with a center axis of a body of a user when the user is in standing posture; pelvis-fixing means capable of moving toward and away from the rotation center; and rotary mechanism support means for supporting the pelvis-fixing means so that the pelvis-fixing means is rotatable about the rotation center and capable of being aligned with a height position of an ilium of the user by causing the pelvis-fixing means to move up and down in parallel with the rotation center. The pelvis-fixing means is arranged so as to be pressed against the height position of the ilium of the user, from front or back side, or is arranged on each of front and back sides of the user so as to sandwich the height position of the ilium of the user from the front and back sides.

21 Claims, 31 Drawing Sheets

(51) Int. Cl.

| | |
|---|---|
| ***A63B 23/02*** | (2006.01) |
| ***A63B 21/02*** | (2006.01) |
| ***A63B 21/05*** | (2006.01) |
| ***A63B 23/035*** | (2006.01) |
| ***A63B 21/04*** | (2006.01) |
| *A63B 23/00* | (2006.01) |

(52) U.S. Cl.
CPC ..... *A63B21/05* (2013.01); *A63B 21/0628* (2015.10); *A63B 21/4049* (2015.10); *A63B 23/03525* (2013.01); *A63B 21/4035* (2015.10); *A63B 2023/003* (2013.01); *A63B 2208/0204* (2013.01)

(56) References Cited

U.S. PATENT DOCUMENTS 4,930,771 A * 6/1990 Wilson ..... A63B 23/03525 482/145
5,433,690 A * 7/1995 Gilman ..... A63B 5/22 482/146
5,449,335 A * 9/1995 Steinfeld ..... A63B 21/00047 482/106
5,474,086 A * 12/1995 McCormick ..... A61B 5/103 600/595
6,120,418 A * 9/2000 Plough ..... A63B 21/0552 482/121
6,325,767 B1 * 12/2001 Wolff ..... A61B 5/224 600/587
6,758,792 B1 * 7/2004 Chang ..... A61H 1/0218 482/118
6,918,856 B2 * 7/2005 Chang ..... A63B 22/14 482/51
7,758,480 B1 * 7/2010 Chen ..... A63B 19/00 482/105
9,056,240 B2 * 6/2015 Carrell ..... A63C 17/061
9,114,274 B2 * 8/2015 Kwon ..... A61H 1/0237
2002/0177511 A1 * 11/2002 Jang ..... A61H 15/00 482/146
2003/0158021 A1 * 8/2003 Prichard ..... A63B 21/04 482/123
2005/0026756 A1 * 2/2005 Chang ..... A63B 22/14 482/136
2008/0096741 A1 * 4/2008 Bradley ..... A47C 9/00 482/130
2010/0317497 A1 * 12/2010 Nadim ..... A63B 21/0618 482/142
2013/0203571 A1 * 8/2013 Kwon ..... A61H 1/0237 482/145
2015/0111707 A1 * 4/2015 Yan ..... A63B 19/00 482/78

FOREIGN PATENT DOCUMENTS

| | | | |
|---|---|---|---|
| JP | 4-50070 | U | 4/1992 |
| JP | 3098514 | U | 3/2004 |
| JP | 2008-200433 | A | 9/2008 |
| JP | 3151306 | U | 6/2009 |
| JP | 2011-217935 | A | 11/2011 |

* cited by examiner

TRAINING APPARATUS

TECHNICAL FIELD

The present invention relates to a training apparatus capable of effectively performing muscle training of the trunk and the muscles surrounding the area from the pelvis to the hip joint.

BACKGROUND ART

It is very important to train the trunk and the muscles surrounding the area from the pelvis to the hip joint for the purpose of strengthening the trunk and enhancing the stability thereof, increasing an abdominal pressure to slim down (reduce the size of) the area around the waist, and adjusting posture. In order to achieve this purpose, some training apparatus and training methods using the training apparatus have been proposed. For example, there are a method involving causing a person who performs muscle training to sit on a seat of the training apparatus, with the pelvis being fixed so as not to move, and causing the person to rotate the shoulders and the chest to twist the upper body, and a training apparatus and method involving causing a person who performs muscle training to sit on a rotatable seat, with the shoulders and the chest being fixed so as not to move, and causing the person to rotate the seat to twist the waist.

The above-mentioned apparatus and methods are all effective for training the trunk, in particular, the external abdominal oblique muscle and the internal abdominal oblique muscle, but are not so effective for training the entire trunk and the muscles surrounding the area from the pelvis to the hip joint.

CITATION LIST

Patent Literature

[PTL 1] JP 3151306 Y2
[PTL 2] JP 3098514 Y2
[PTL 3] JP 4-50070 U
[PTL 4] JP 2011-217935 A
[PTL 5] JP 49-127096 U

SUMMARY OF INVENTION

Technical Problem

In view of the above-mentioned circumstance, it is an object of the present invention to provide a training apparatus enabling effective training of not only the trunk but also the muscles surrounding the area from the pelvis to the hip joint.

Solution to Problem

The inventor of the present invention studied the relationship between the human body notion and the muscle movement. As a result, the inventor of the present invention found that when a person who performs training takes predetermined standing posture and rotates the upper body including the pelvis, with a center axis of the body being a rotation center, so as not to deform the upper body, the trunk and the muscles surrounding the area from the pelvis to the hip joint are subjected to contraction such as concentric contraction, eccentric contraction, and isometric contraction in a wide range, and the trunk and the muscles surrounding the area from the pelvis to the hip joint can be effectively trained by repeating the rotary motion. Then, the inventor of the present invention continuously conducted earnest studies based on the finding, and consequently completed a training apparatus of the present invention suitable for achieving the above-mentioned object, which enables effective training of the trunk and the like by easily repeating the rotary motion. Note that, a person who uses the training apparatus of the present invention for the purpose of performing muscle training is hereinafter referred to as a "user".

That is, according to one aspect of the present invention, the above-mentioned object can be achieved by a training apparatus, including: a rotation center to be substantially matched with a center axis of a body of a user when the user is in standing posture; pelvis-fixing means capable of moving toward and away from the rotation center; and rotary mechanism support means for supporting the pelvis-fixing means so that the pelvis-fixing means is rotatable about the rotation center and capable of being aligned with a height position of an ilium of the user by causing the pelvis-fixing means to move up and down in parallel with the rotation center. Throughout the present specification and in the claims, the pelvis-fixing means may alternatively be described as a pelvis resting member. The pelvis-fixing means (pelvis resting member) is configured to be contacted by, and to support a user's midsection.

The pelvis-fixing means may be arranged so as to be pressed against the height position of the ilium of the user from a front side or a back side of the user. Alternatively, the pelvis-fixing means may be arranged on each of front and back sides of the user so as to sandwich the height position of the ilium of the user from the front and back sides. Alternatively, one set of at least two pelvis-fixing means may be arranged in an inverted V shape in a plan view or in left-right symmetry. Herein, the term "inverted V shape" generally refers to a state in which at least two pelvis-fixing means are connected in a horizontal direction as needed and arranged in an inverted V shape when viewed from above (the same applies hereinafter). Further, the term "left-right symmetry" refers to a state in which one set of at least two pelvis-fixing means arranged in a horizontal direction or a vertical direction, or in both the directions, with a plane in a front-back direction passing through the rotation center being the center, are arranged in left-right symmetry when viewed from the user, and includes the "inverted V shape" (the same applies hereinafter). The set of the pelvis-fixing means mentioned above may be arranged so as to be pressed against the user from a front side or a back side of the user, or may be arranged respectively on front and back sides of the user so as to sandwich the user from the front and back sides. Further, the pelvis-fixing means may further include, in an upper part thereof, an upper body support section for regulating the motion of the upper body of the user. The pelvis-fixing means is capable of moving toward and away from the rotation center.

The rotary mechanism support means may include a rotary mechanism configured so as to rotate the pelvis-fixing means about the rotation center, and support means capable of aligning the rotary mechanism by moving up and down the rotary mechanism in parallel with the rotation center. The rotary mechanism may include a rotary table and rotary table support means for rotatably supporting the rotary table, and the rotary table may have a substantially horseshoe shape in a plan view in which a cut-out region is formed, the cut-out region extending from a part of an outer periphery of a substantially disc-shaped body in a plan view to approach a part of the outer periphery on an opposite side thereto in a diameter direction by passing through a center. Alternatively, the rotary mechanism may include a rotary table and rotary table support means for rotatably supporting the rotary table, and the rotary table may have a donut shape in a plan view in which an insertion hole is formed in a center region of the rotary table in a manner that the insertion hole passes through a front surface and a back surface of the rotary table so as to be substantially concentric with the center region and the body of the user is capable of entering the insertion hole.

The rotary mechanism and the support means may be independent from each other, and the former may include a part or a whole of components of the latter. Further, a component group enabling the pelvis-fixing means to move toward and away from the rotation center may be independent from the rotary mechanism and the support means, and a part or a whole of the component group enabling the above described motion of the pelvis-fixing means may be included in the rotary mechanism or the support means, or in both the rotary mechanism and the support means.

The rotary table support means may include braking means for applying a braking force to the rotary table. Further, the rotary table support means may include load adjusting means capable of adjusting a load to be applied to the rotary table during rotation of the rotary table. It is preferred that the load adjusting means apply a load to the rotation of the rotary table from a right direction to a left direction or from the left direction to the right direction when viewed from the user without switching a direction of the load applied.

The rotary mechanism may include an arc-shaped rail with the rotation center being a center, a traveling body configured to travel along the arc-shaped rail, and a guide section for supporting a movable body supporting the pelvis-fixing means in an end portion on the rotation center side of the traveling body so that the movable body is capable of sliding and moving. In this case, the guide section serving as a part of the component enabling the above mentioned motion of the pelvis-fixing means is included in the rotary mechanism. It is preferred that a stopper for regulating the traveling of the traveling body be provided at each of both ends of the arc-shaped rail.

Further, the guide section may include a pair of guide members arranged at both ends in a width direction of the guide section, and the movable body may be capable of sliding and moving in a radial direction of the arc-shaped rail with both edges thereof being respectively fitted in guide grooves provided in surfaces opposed to each other of the pair of guide members. Each of the guide grooves may be formed into a substantially V shape in a cross section taken in a direction orthogonal to the sliding and moving direction, and both the edges of the movable body may be formed into an arc shape swelling to an outer side in a cross section taken in the same direction. At this time, it is preferred that the guide member be formed of a plastic material.

Further, the rotary mechanism may include braking means for applying a braking force to the traveling body respectively in portions close to both the end portions of the arc-shaped rail. Each of the braking means may include an elastic body, and an urging force of the elastic body, which increases in inverse proportion to an approaching distance of the traveling body to the stopper, may serve as the braking force. The rotary mechanism may include load adjusting means capable of adjusting a load to be applied to the traveling body during traveling of the traveling body.

A support shaft may be erected from a portion in a vicinity of feet of the user taking the standing posture, and the support shaft may include a shaft center matched with the rotation center. Further, a rotator section formed so as to be sandwiched between knees of the user may be provided in an upper end portion of the support shaft so as to rotate about the rotation center. Moreover, in the portion in the vicinity of the feet of the user taking the standing posture, there may be provided one of an inclined surface having a rising slope from a heel to a toe of the user and an indication for calling attention of the user so that the user places both legs into a pigeon-toed state, or the indication being provided on the inclined surface. Further, a bar-shaped body that enables the user to place forward regions of both the feet thereon may be arranged so as to move in a front-back direction between the rotation center and the rotary mechanism support means, the bar-shaped body being arranged substantially in parallel with the forehead surface of the user in front of the feet of the user. The user may place the forward regions of both the feet on the bar-shaped body so that a rising slope is formed from the heel to the toe of the user.

Further, according to another aspect of the present invention, the above-mentioned object can be achieved by a training apparatus, including: a rotation center to be substantially matched with a center axis of a body of a user when the user is in standing posture; a base including a rotary table that allows the user to get thereon in the standing posture and is capable of rotating about the rotation center; pelvis-fixing means capable of moving toward and away from the rotation center; and support means for supporting the pelvis-fixing means so that the pelvis-fixing means is capable of moving up and down in parallel with the rotation center, the support means being capable of aligning the pelvis-fixing means with a height position of an ilium of the user.

The pelvis-fixing means may be arranged so as to be pressed against the height position of the ilium of the user from a front side or a back side of the user. Alternatively, the pelvis-fixing means may be arranged on each of front and back sides of the user so as to sandwich the height position of the ilium of the user from the front and back sides. Alternatively, one set of at least two pelvis-fixing means may be arranged in an inverted V shape in a plan view or in left-right symmetry. The pelvis-fixing means configured as the above-mentioned one set having such a configuration may be arranged so as to be pressed against the user from a front side or a back side of the user, or may be arranged respectively on front and back sides of the user so as to sandwich the user from the front and back sides. Further, the pelvis-fixing means may further include, in an upper part thereof, an upper body support section for regulating the motion of the upper body of the user.

The training apparatus of the present invention includes the rotation center to be substantially matched with the center axis of the body of the user when the user is in the standing posture, the pelvis-fixing means for fixing the height position of the ilium of the user, and the rotary mechanism support means for rotating the pelvis-fixing means about the rotation center while aligning the pelvis-fixing means with the height position of the ilium of the user. Therefore, the user can perform training of repeatedly rotating the upper body including the pelvis easily in a short period of time so as not to deform the upper body. Consequently, the user can perform effective training of the trunk and the muscles surrounding the area from the pelvis to the hip joint, resulting in strengthening the trunk and enhancing the stability thereof, increasing an abdominal pressure to slim down (reduce the size of) the area around the waist, and further adjusting posture.

BRIEF DESCRIPTION OF DRAWINGS

FIGS. 24 are views

DESCRIPTION OF EMBODIMENTS

First, the principle of a training method using a training apparatus of the present invention is described with reference to FIG. 1. Note that, the term "user" as used herein refers to a person who performs muscle training using the training apparatus of the present invention. Further, the term "right" or "left" is used in the sense of a right or a left when viewed from the user. Further, the term "right direction" or "left direction" is used in the sense of a direction when viewed from the user, and the explicit description of "when viewed from the user" is omitted. Further, the term "rotary mechanism" as used herein is intended to be used in the sense of including not only components for serving to rotate pelvis-fixing means about a rotation center but also respective components serving to regulate and stop the rotation of the pelvis-fixing means, to cause the pelvis-fixing means to rotate under a load, and to cause a rotation angle to be indicated (description of each component is described later). Further, the term "rotation" is intended to be used in the sense of including not only a horizontal rotation in a clockwise or counterclockwise direction but also alternate rotations in both the directions.

Figure 1:
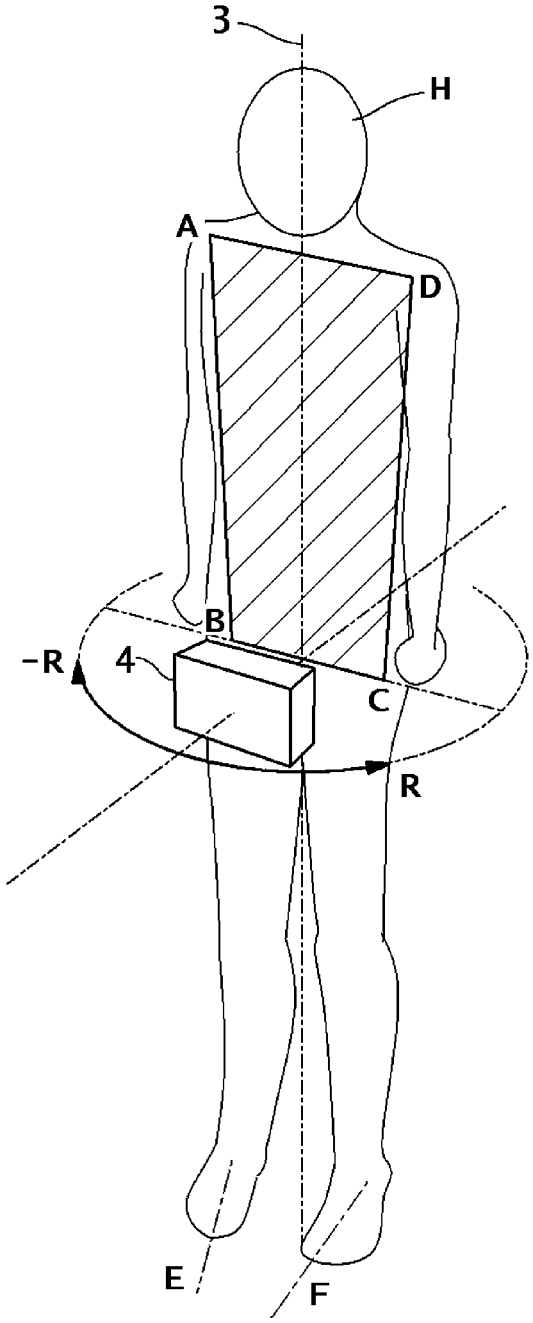
FIG. 1 is a view illustrating a principle of training using a training apparatus of the present invention.

As illustrated in FIG. 1, for performing training, a user H places both feet substantially pelvic width apart to shoulder width apart and takes standing posture so that a center axis of the body substantially matches with a rotation center 3 of the apparatus. Herein, the term "center axis of a body" means a line (axis) where a plane passing through all respective points of right and left ears, the center of the right and left shoulders, the front surface of the first lumbar vertebra, the center of the right and left hip joints, the center of the right and left knees, and the forward ends of the right and left ankles of the user H crosses a median sagittal plane (plane that equally divides a human body having left-right symmetry to the right and left along a median line of the body) when the user H takes standing posture so that the points are aligned in a straight line in an up-and-down direction, preferably, in a vertical direction (the center axis of the body is sometimes referred to as "perpendicular axis"). As a result, a rectangle ABCD obtained by connecting positions A and D of joints of both the shoulders of the user H and positions B and C at outermost edges of the ilium on both sides of the pelvis is formed in the upper body. Further, the term "rotation center" also includes a virtual line extending upward in the vertical direction from the rotation center of the training apparatus of the present invention.

For starting training, the user H presses pelvis-fixing means 4 against the height position of the ilium of the user H from a front side to further erect the pelvis. In this state, the user H rotates the upper body including the pelvis (lower abdomen and waist) alternately in the right direction and in the left direction (in a range of from P to as an example in the figure) when viewed from the user H so as not to deform (bend, twist, etc.) the above-mentioned rectangle ABCD or deviate the center axis of the body from the rotation center 3. As a result, the user H subjects not only the trunk such as the transverse abdominal muscle, the rectus abdominal muscle, the external abdominal oblique muscle, the internal abdominal oblique muscle, the iliopsoas muscle (psoas major muscle, psoas minor muscle, iliac muscle), the lumbar quadrate muscle, the lumbar iliocostal muscle, the multifidus muscle, the erector muscle of spine, the iliac muscle, and the gluteus medius muscle but also the muscles surrounding the area from the pelvis to the hip joint to contraction such as concentric contraction, eccentric contraction, and isometric contraction. Thus, the contraction of those muscles is repeated by repeating the rotary motion, with the result that training is performed effectively. In this case, more effective training can be performed by applying an appropriate resistance (load) against the rotation direction, by causing the user H to turn both the feet inwardly into a pigeon-toed state, or by causing the user H to stand on an inclined foot rest or the like and place toe sides of both the feet at a position higher than that of the ankles in a pigeon-toed state. Further, the pelvis-fixing means 4 corresponds to pelvis-fixing means 4, 57 in a first embodiment and a third embodiment of the present invention. Further, the pelvis-fixing means 4 can be used, for example, as one set of two pelvis-fixing means 46, 46 in a second embodiment of the present invention or as one set of two pelvis-fixing means 73, 73 in a fourth embodiment of the present invention by appropriately changing the size of the pelvis-fixing means 4.

Next, the training apparatus according to the embodiments of the present invention are described in detail with reference to the accompanying drawings. The accompanying drawings also include those not illustrating the user H. However, for convenience of description, descriptions are made below using the term "user H" assuming that the user H is illustrated even in each figure not illustrating the user H.

[First Embodiment]

Figure 2:
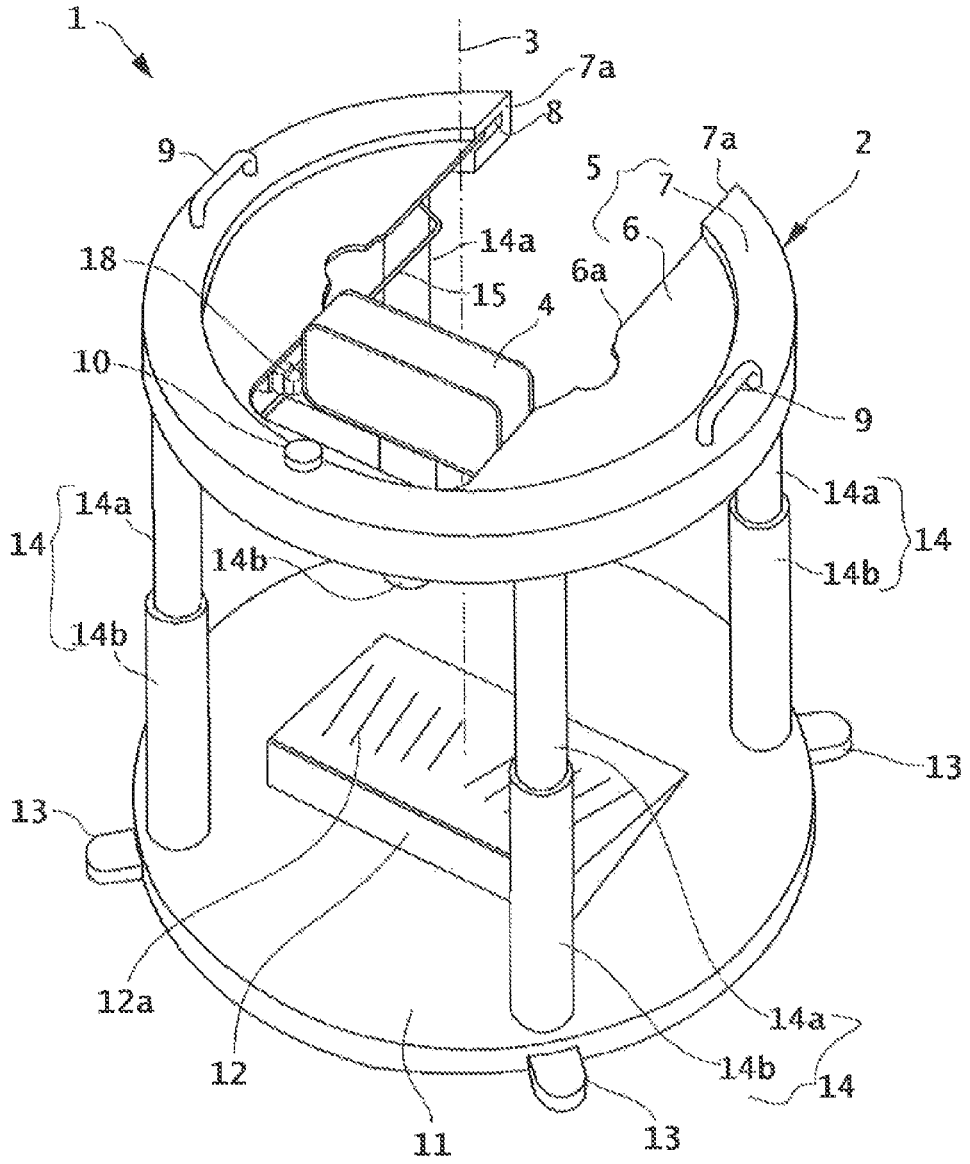
FIG. 2 is a perspective view illustrating a training apparatus according to a first embodiment of the present invention.
Figure 3:
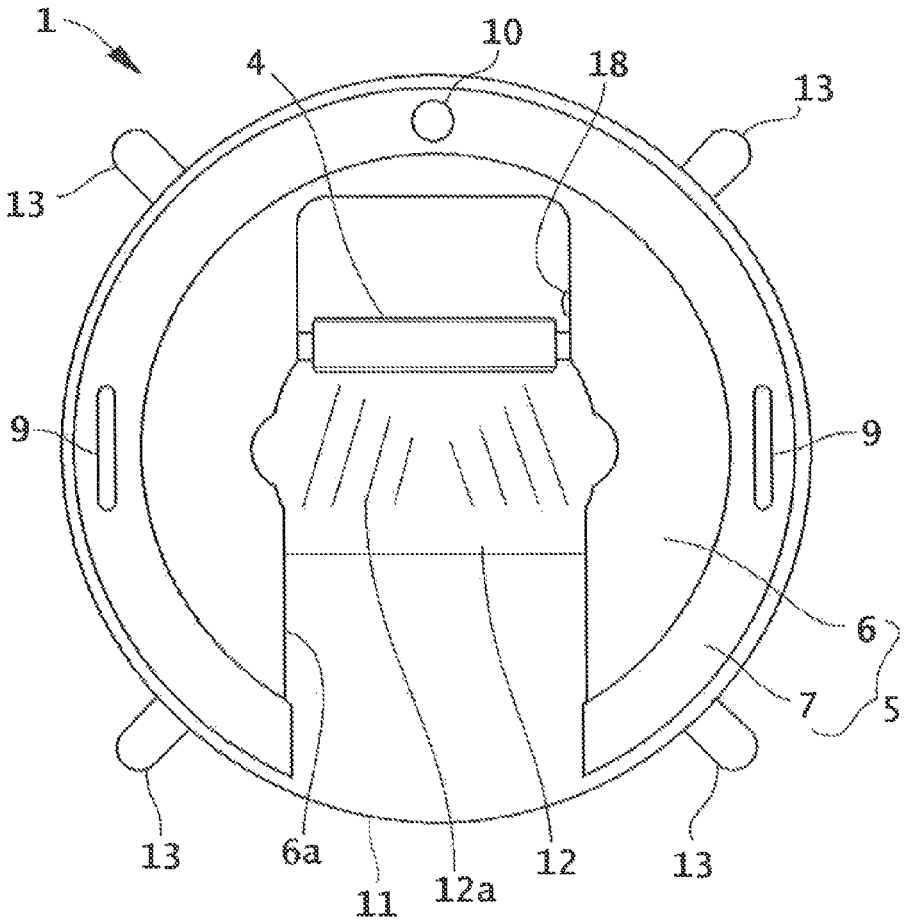
FIG. 3 is a plan view of the embodiment illustrated in FIG. 2.
Figure 4:
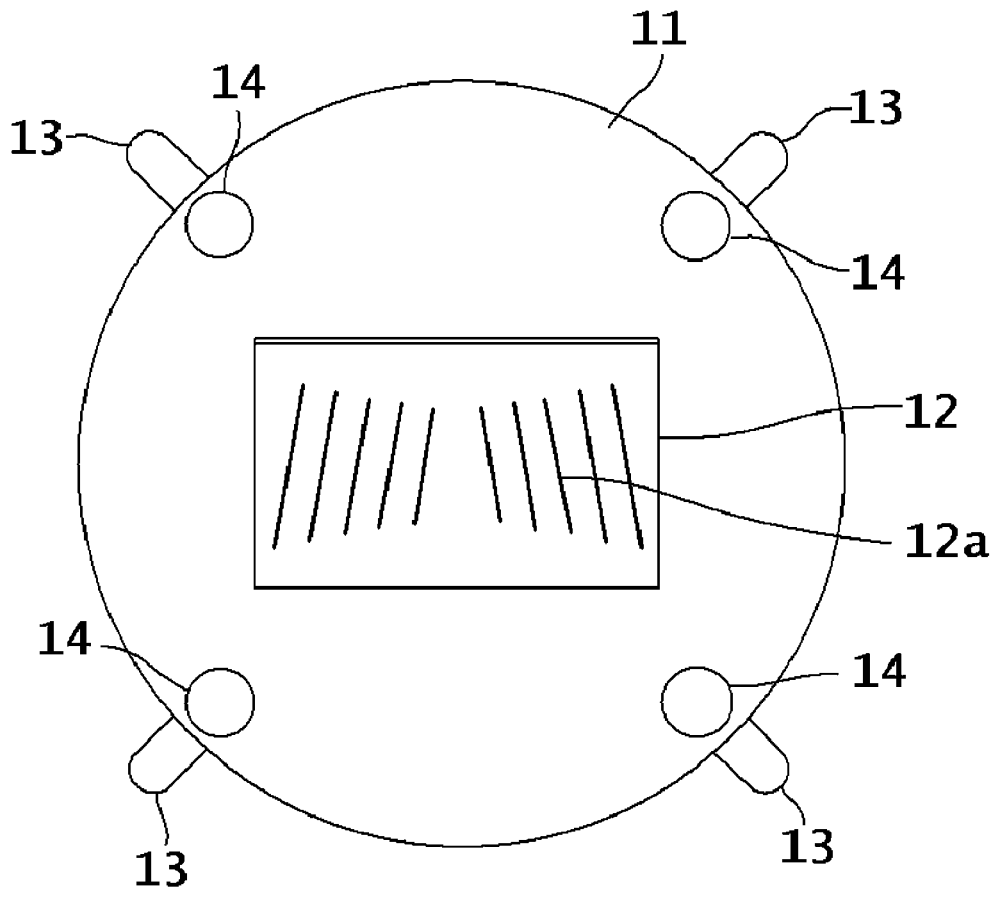
FIG. 4 is a plan view of a base according to the embodiment illustrated in FIG. 2.

FIG. 2 is a perspective view illustrating a training apparatus according to a first embodiment of the present invention. FIG. 3 is a plan view of the first embodiment. Further, FIG. 4 is a plan view of a base section of the first embodiment, FIG. 5A a front view of the first embodiment, and FIG. 5B is a side view of the first embodiment.

As illustrated in FIG. 2, a training apparatus 1 of the this embodiment includes pelvis-fixing means 4 capable of rotating about a rotation center 3 of the apparatus, and rotary mechanism support means 2 for supporting the pelvis-fixing means 4 so that the pelvis-fixing means 4 is rotatable and can be aligned with the height position of the ilium of the user H. The rotary mechanism support means 2 mainly includes a rotary mechanism 5 having a substantially horseshoe shape in a plan view including a rotary table 6 and a rotary table support means 7 for rotatably supporting the rotary table 6, four support columns 14, 14, 14, 14 serving as support means extending downward from a peripheral edge portion of a lower surface of the rotary mechanism 5 at a predetermined interval in a circumferential direction of the lower surface, and a base 11 having a circular shape in a plan view, which is mounted on a floor surface and supports and fixes a lower end of each of the support columns 14, 14, 14, 14. The base 11 may also be referred to as a support base, and it will be understood that the support base 11 is configured to remain stationary during use of the training apparatus 1.

As described above, the rotation center 3 serves as a reference for the user H to take predetermined standing posture so that the center axis of the body substantially matches with the rotation center 3 and to perform the movement of rotating the upper body including the pelvis (lower abdomen and waist) about the rotation center 3 so as not to deform the rectangle ABCD illustrated in FIG. 1, and serves as an important element in the training apparatus 1 of the present invention. When the user H uses the training apparatus 1 of this embodiment, for example, a mirror or the like may he set in the vicinity of the training apparatus 1 so that the user H can control the center axis of the body, in such a manner that the center axis of the body and the rotation center 3 are not deviated from each other in the case where the user H gets on the base 11 and rotates the upper body including the pelvis (lower abdomen and waist) in a right-and-left direction.

As illustrated in FIGS. 2 and 3, the rotary mechanism 5 includes the rotary table 5 having a substantially horseshoe shape in a plan view and the rotary table support means 7 for rotatably supporting a circumferential portion of the rotary table 6. The rotary table 6 is formed so as to have a substantially horseshoe shape in a plan view, in which a cut-out region 6*a* is formed so as to extend from a part of an outer periphery of the rotary table 6 to approach a part of the outer periphery on an opposite side thereto in a diameter direction by passing through a center of the rotary table 6. The width of the cut-out region 6*a* in a direction orthogonal to a direction in which the cut-out region 6*a* is formed is set to such a degree that the user H can proceed straight toward the center of the rotary table 6 without any obstacle in the cut-out region 6*a* (for example, about 460 mm). This width can be changed appropriately.

Note that, the rotary table 6 is not limited to the above-mentioned shape, as long as the rotary table 6 has a substantially disc shape so that the rotary table support means 7 rotatably supports a circumferential portion of the rotary table 6 (the rotary table itself may or may not include a rotation axis), a through-hole through which the body of the user H passes is formed in a center region including the center thereof that matches with the rotation center 3, and the center axis of the body can substantially match with the rotation center 3. For example, the rotary table 6 may be formed so as to have a donut shape in a plan view in which an insertion hole having a substantially circular shape in a plan view is formed in the center region of the rotary table 6 in a manner that the insertion hole passes through a front surface and a back surface of the rotary table 6 so as to be substantially concentric with the center of the center region and the body of the user H is capable of entering the insertion hole.

Further, the center region of an upper surface of the rotary table 6 can be provided with a marker indicating the degree of rotation in a right direction or in a left direction when viewed from the user H. The marker can also include a marker that indicates the position in a non-rotating state.

An outer shape of the pelvis-fixing means 4 in this embodiment is a substantially rectangular parallelepiped (substantially quadratic prism), and a surface that is pressed against the height position of the ilium of the user H (hereinafter also referred to as "abutment surface" in some cases) is formed of a soft material. Note that, the outer shape of the pelvis-fixing means 4 is not limited to a substantially rectangular parallelepiped and can be appropriately selected and adopted from various publicly known three-dimensional shapes. Specific examples of the publicly known three-dimensional shapes include a curved plate-shaped body as well as a substantially cylindrical shape and a substantially elliptic cylindrical shape. Further, the pelvis-fixing means 4 may have a structure that can be separated into some portions. For example, the above-mentioned front surface may be farmed of a vertical or horizontal arrangement of at least two cylinders or prismatic bodies.

The abutment surface of the pelvis-fixing means 4 can be formed into a shape depressed from both side edges to an intermediate region in accordance with the outer shape in the horizontal direction of the lower abdomen or the waist of the user H so that, when the pelvis-fixing means 4 is pressed against the height position of the ilium of the user H, a contact area thereof is enlarged so as to easily bring the pelvis-fixing means 4 into close contact with the height position. Further, in the case where the pelvis-fixing means 4 is pressed against the height position of the ilium of the user H from the forward side, a region close to an upper end of the abutment surface can also be formed so as to be positioned closer to the rotation center 3, compared to a region close to a lower end of the abutment surface. For example, there is given the case where the surface on the user H side is inclined with respect to the vertical direction and formed to face downward. Consequently, the user H can erect the pelvis of the user H by pressing the height position of the ilium against the entire abutment surface of the pelvis-fixing means 4.

Although there is no particular limitation to the size of the pelvis-fixing means 4, considering the usage of the training apparatus of the present invention in which the user H rotates the upper body including the pelvis (lower abdomen and waist) so as not to deform the rectangle ABCD (see FIG. 1) of the upper body, it is preferred that the size of the abutment surface be set to such a degree that the abutment surface can be pressed against the height position of the ilium of the user H. As an example of the size in the case where the outer shape is a substantially rectangular parallelepiped, the pelvis-fixing means 4 can be set to a size having a vertical length (vertical direction) of from about 130 mm to about 200 mm (165 mm as an intermediate value), a horizontal length (horizontal direction) of from about 340 mm to about 400 mm (370 mm as an intermediate value), and a depth length from about 80 mm to about 200 mm. Note that, pelvis-fixing means that are relatively smaller than the size exemplified above may be used and combined vertically and horizontally to form a size substantially equal to the above-mentioned size as a whole.

Figure 6:
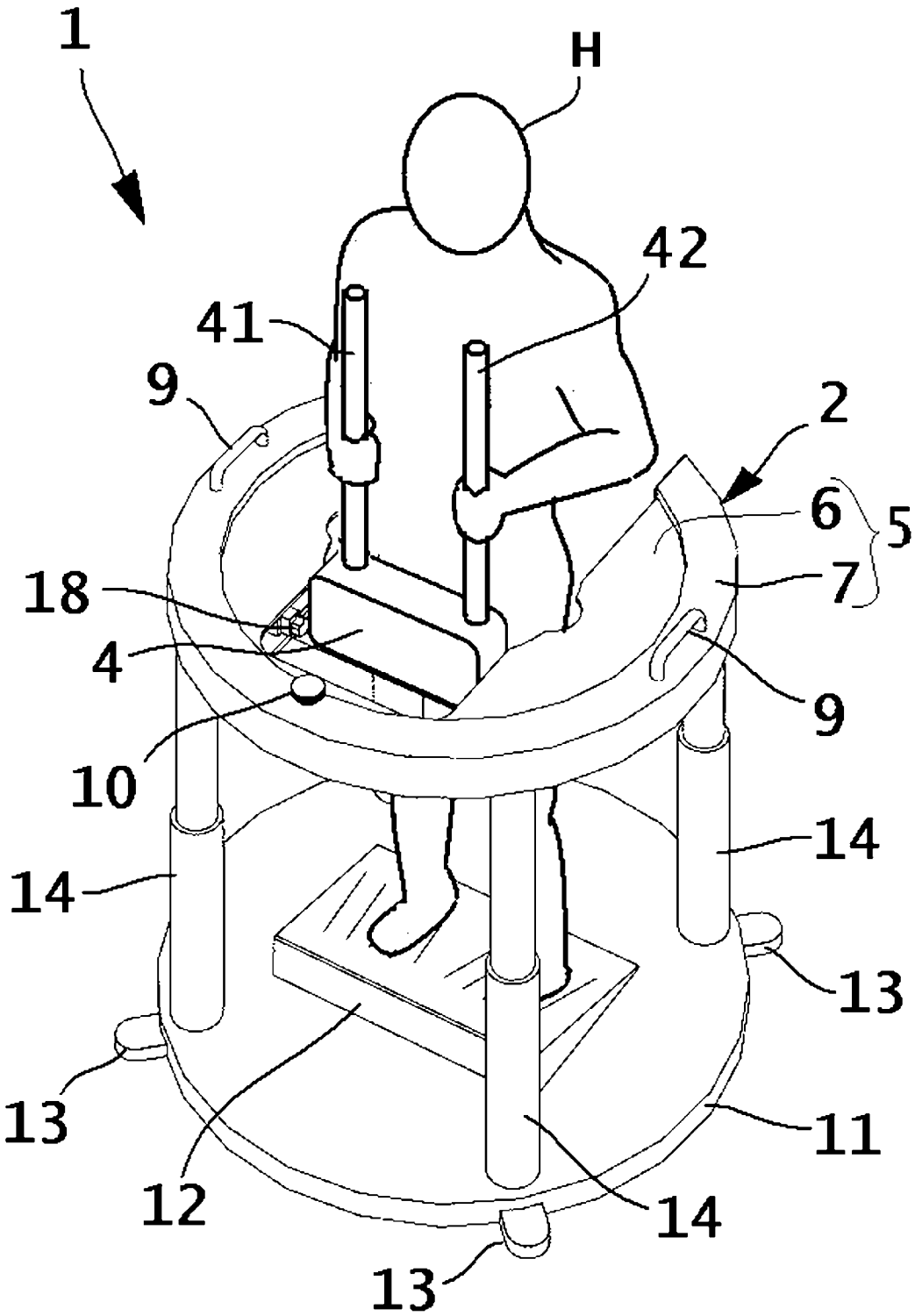
FIG. 6 is a perspective view illustrating a modified example of pelvis-fixing means.

As illustrated in a modified example of FIG. 6, two poles serving as upper body support sections can be erected perpendicularly to the upper surface of the pelvis-fixing means 4 respectively from positions close to both edges on the upper surface. The user H grips or puts the hands on the respective two poles 41, 42 while pressing the pelvis-fixing means 4 against the height position of the ilium of the user H as illustrated so that the rectangle ARCH of the upper body illustrated in FIG. 1 can be fixed without being deformed and the deviation of the center axis of the body of the user H from the rotation center 3 can be suppressed during the rotary motion of the upper body including the pelvis (lower abdomen and waist). As a result, more effective muscle training of a predetermined part can be performed. Note that, the upper body support section is not particularly limited to the configuration formed of the illustrated two poles 41, 42 as long as the upper body can be fixed as described above. It is also preferred to use an upper body support section employing a single pole, a plate having an appropriate with and thickness similarly erected from the upper surface of the pelvis-fixing means 4, or arms respectively protruding further forward from both edges of the upper surface of the pelvis-fixing means 4 so that the user H can grip the respective arms with both the hands. Further, as the upper body support section or an accessory to the upper body support section, there can also be used equipment or the like that can mechanically fix the rectangle ARCH (see FIG. 1) of the upper body of the user H so as not to be deformed.

Figure 7:
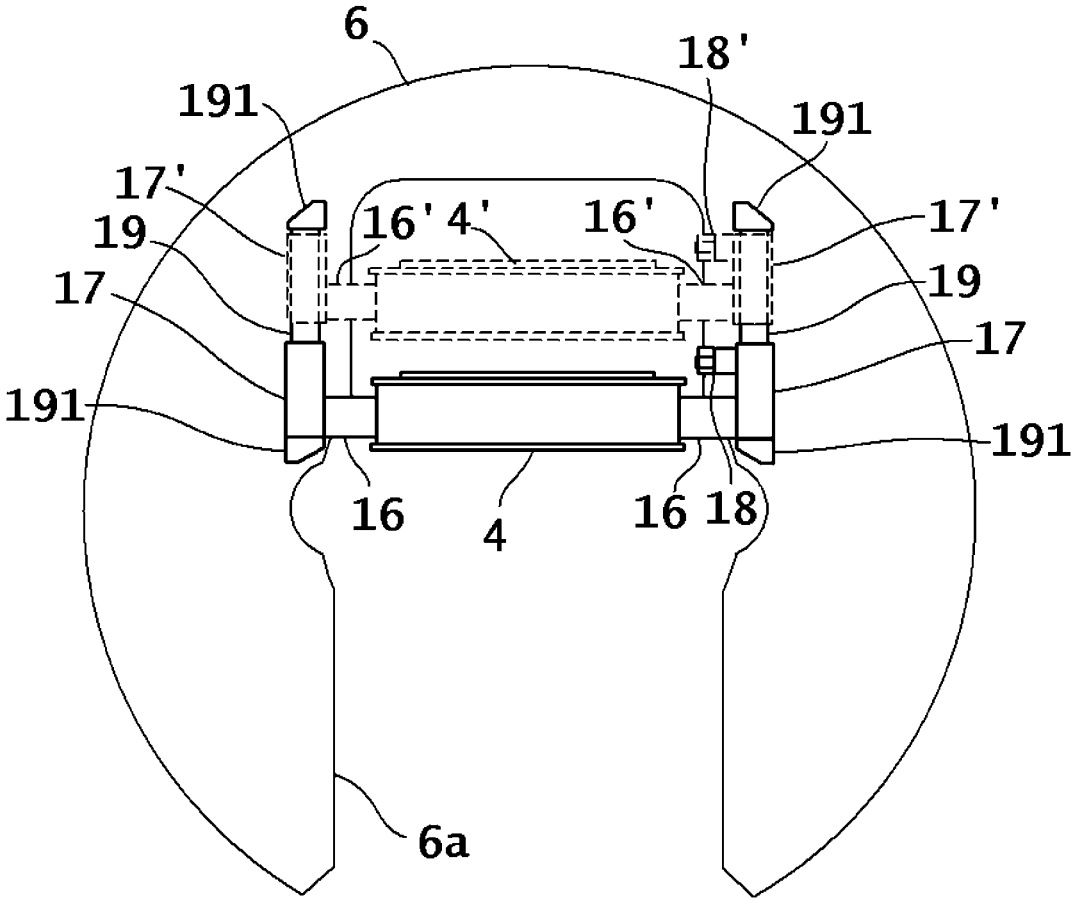
FIG. 7 is a view illustrating a mounting state and a moving mechanism of the pelvis-fixing means according to the embodiment illustrated in FIG. 2.

The pelvis-fixing means 4 is mounted on a lower surface of the rotary table 6 so as to be movable toward and away from the rotation center 3 in the cut-out region 6*a* of the rotary table 6. FIG. 7 illustrates an example of a mounting state of the pelvis-fixing means 4 on the lower surface of the rotary table 6. Note that, in the following description, a lower side in FIG. 7 (opening side of the cut-out region 6*a* of the rotary table 6 having a substantially horseshoe shape) is referred to as a near side, and an upper side in FIG. 7 (deep side of the cut-out region 6*a*) is referred as a deep side.

In FIG. 7, shafts 16, 16 respectively extend from both side surfaces of the pelvis-fixing means 4 in a width direction of the cut-out region 6*a* , and portions close to one end in the opening direction of sheathed pipes 17, 17 are fixed at respective tip ends of the shafts 16, 16 in a direction orthogonal to the shafts 16. One of the two sheathed pipes 17, 17 is provided with a locking section 18 at a position close to the other end in the opening direction of the sheathed pipe 17.

On the other hand, a pair of guide rails 19, 19 respectively including stoppers 191, 191 at both ends are provided on the lower surface of the rotary table 6 so as to be parallel to each other along both edges on the deep side of the cut-out region 6*a* . The sheathed pipes 17, 17 present in both side portions of the pelvis-fixing means 4 are respectively fitted onto the pair of the guide rails 19, 19. Thus, the pelvis-fixing means 4 is capable of sliding and moving toward or away from the rotation center 3 along the guide rails 19, 19 (herein, a combination of the guide rail 19 and the sheathed pipe 17 forms a slide movement mechanism). Note that, the cross section of the guide rail 19 can be formed into a publicly known shape such as a circle, an oval, a rectangle, or a square, and the outer shape of the sheathed pipe 17 to be fitted onto the guide rail 19 can also be changed depending on the cross section shape of the guide rail 19. Further, in this embodiment, the pelvis-fixing means 4 is movably connected to the guide rail 19 through intermediation of the shaft 16 and the sheathed pipe 17 as described above. However, the pelvis-fixing means 4 is not limited to this configuration, and for example, the following configuration may be adopted. A belt may be mounted on the pelvis-fixing means 4, and the pelvis-fixing means 4 may be movably connected to the guide rail through belt fastening.

The user H can fix the pelvis-fixing means 4 by stopping the pelvis-fixing means 4 at any position on the guide rail 19 (for example, a position denoted by reference numeral 4') through operation of the locking section 18. The locking section 18 to be used can be appropriately selected from publicly known locking sections having related-art structures. For example, there are given a structure in which a pin (not shown) that moves into or out of the locking section 18 by the operation of the locking section 18 is provided, and a plurality of pin holes accommodating the pin are arranged on a side surface of the guide rail 19, and a structure in which the side surface of the guide rail 19 is pressed by the operation of the locking section 18.

As illustrated in FIG. 2, the training apparatus 1 of this embodiment has a configuration in which the pelvis-fixing means 4 is pressed against the height position of the ilium of the user H only from the front side. However, the training apparatus 1 of this embodiment is not limited thereto. It may also be possible to adopt a configuration in which pelvis-fixing means having a similar outer shape and size is pressed against the height position of the ilium from the back side, or a configuration in which one set of at least two pelvis-fixing means are prepared, and the one set of the pelvis-fixing means sandwich the height position of the ilium respectively from the front and back sides of the user H. Both in the case where the pelvis-fixing means is pressed against the height position of the ilium from the back side and in the case where the one set of the pelvis-fixing means is moved, the slide movement mechanism of the pelvis-fixing means can adopt the same configuration as that using the pair of the guide rails 19, 19 and the sheathed pipes 17, 17 to be fitted thereonto illustrated in FIG. 7.

Figure 8:
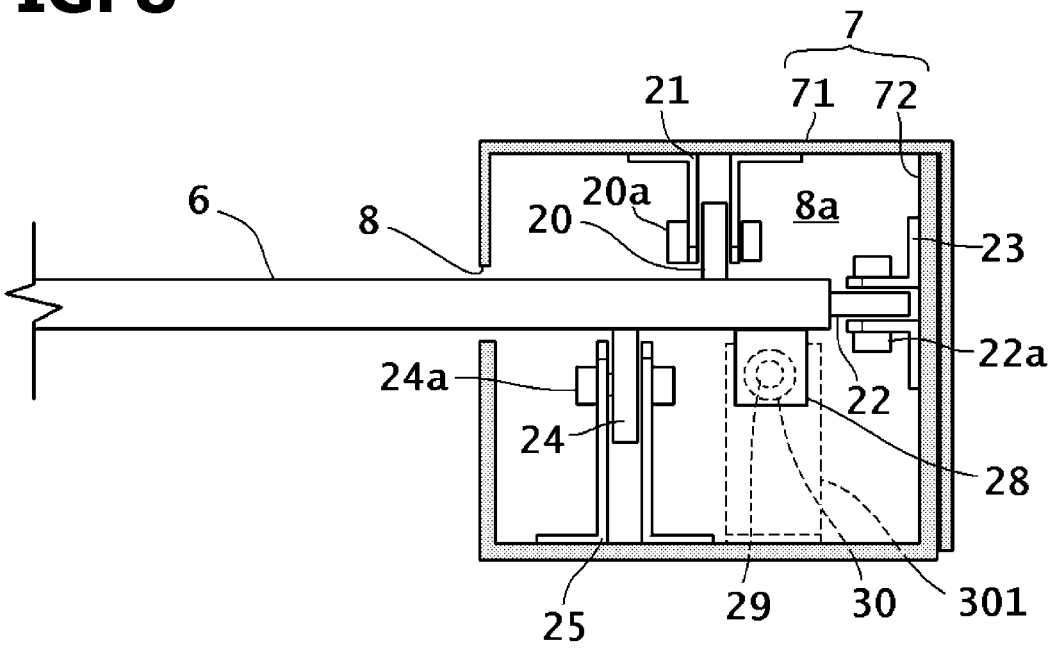
FIG. 8 is a detailed sectional view of a rotary mechanism illustrated in FIG. 2.

As illustrated in FIGS. 2 and 3, the rotary table support means 7 in this embodiment has a shape obtained by removing an arc portion having a width substantially equal to the width of the cut-out region 6*a* in the rotary table 8 from a substantially donut shape in a plan view having a substantially rectangular cross section in a direction orthogonal to a circumferential direction. The rotary table support means 7 includes a housing 72 and a lid 71 as illustrated in FIG. 8. An opening 8 is formed in the circumferential direction from an inner surface of the rotary table support means 7 through two end surfaces (see reference numerals 7*a* , 7*a* of FIG. 2) formed by the above-mentioned removal. The shapes of the housing 72 and the lid 71 can be set so that the opening 8 is formed by mounting the lid 71 on an upper portion of the housing 72. The opening 8 accommodates a circumferential portion of the rotary table 6 (see FIG. 2), and a hollow inner portion of the rotary table support means 7 is defined as an accommodating chamber 8*a* for the circumferential portion of the rotary table 6 (see FIG. 8).

A lower surface and a circumferential end surface of the circumferential portion of the rotary table 6 accommodated in the rotary table support means 7 are supported respectively by bearings 24 and 22. The bearings 24, 22 include shafts 24*a* , 22*a* that are supported rotatably by shaft support sections 25, 23 mounted on a bottom surface of the housing 72 and an inner surface of an outer wall of the housing 72. Further, an upper surface of the circumferential portion of the rotary table 6 is supported so as to be pressed from above by a bearing 20 mounted rotatably on the lid 71 side. The bearing 20 also includes a shaft 20*a* that is supported rotatably by a shaft support section 21 mounted on an inner surface of a top plate of the lid 71. Note that, an outer peripheral surface of each of the bearings 20, 22, and 24 can be lined with rubber or a resin so as to prevent a friction sound with the rotary table 6. Rollers each having a shaft can be substituted for the bearings 20, 22, and 24. An outer peripheral surface of the roller can also be lined with rubber or the like.

An outer frame of the rotary table support means 7 is formed of the lid 71 and the housing 72 as described above. Therefore, when the rotary mechanism 5 of this embodiment is assembled, the rotary table 6 is set so that the circumferential portion thereof is accommodated in the housing 72 while the lid 71 is not mounted on the housing 72, and then the lid 71 can be mounted on the housing 72. Therefore, there is an advantage in that the assembly operation of the training apparatus of this embodiment can be made efficient.

Figure 9:
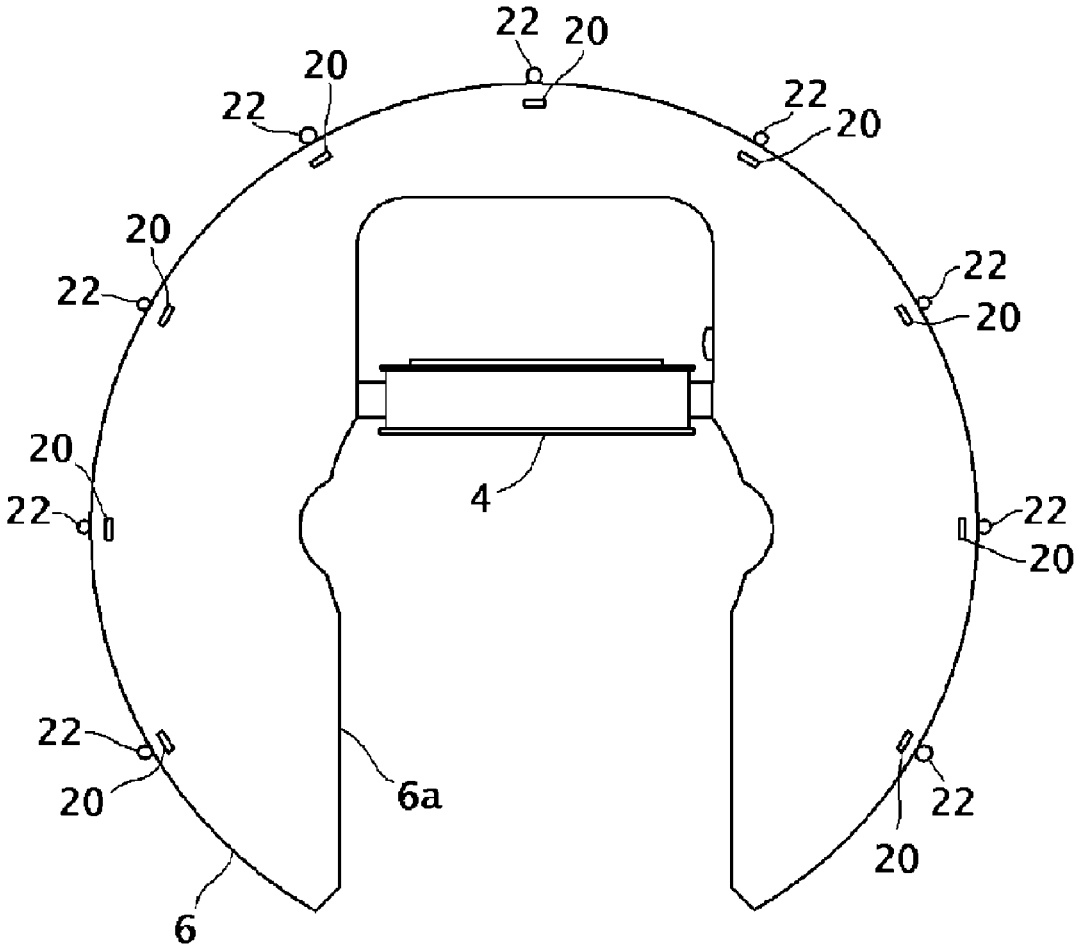
FIG. 9 is a view illustrating a support state of a rotary table by rotary table support means.

FIG. 9 illustrates an arrangement state of the bearings in the rotary table support means 7 and a support state of the rotary table 6 by the bearings. In FIG. 9, although only the bearings 20 and 22 are illustrated, it is assumed that the bearing 24 illustrated in FIG. 8 is also provided at a position corresponding to the bearing 20 on a back surface side of the rotary table 6. Thus, nine sets of the bearings 20, 22, and 24 are respectively arranged at about every 30° in the circumferential direction of the rotary table 6, and a total of 27 bearings rotatably support the rotary table 6. Note that, the arrangement of the bearings 20, 22, and 24 (interval of adjacent bearings, and number and arrangement of bearings) is not limited to the arrangement example illustrated in FIG. 9, and can be appropriately set considering the weight and the like of the rotary table 6. Further, a rotary wheel having the same function as that of the bearing denoted by reference numeral 20 and the like can be substituted for the bearing 20.

Figure 10:
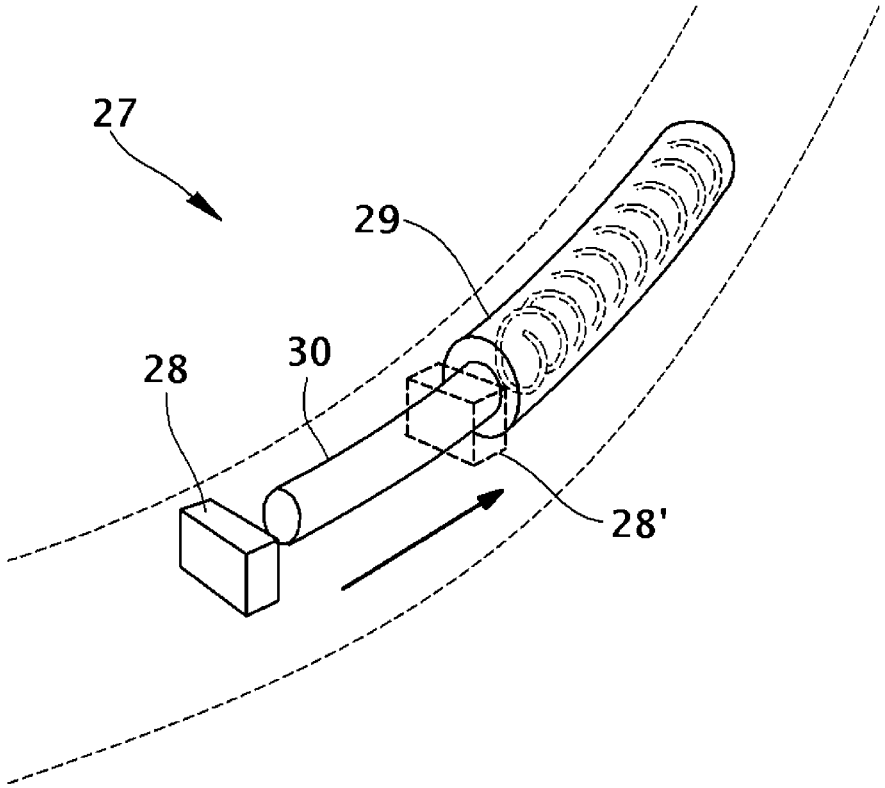
FIG. 10 is a view illustrating an example of braking means.

FIG. 10 schematically illustrates an example of braking means for applying a braking force to the rotary table 6. In FIG. 10, reference numerals 27, 28, 29, and 30 denote braking means, a protruding part, a braking cylinder, and a rod section thereof, respectively. A compression coil spring for urging the rod section 30 in a protruding direction is accommodated in the braking cylinder 29 as illustrated.

Figure 11:
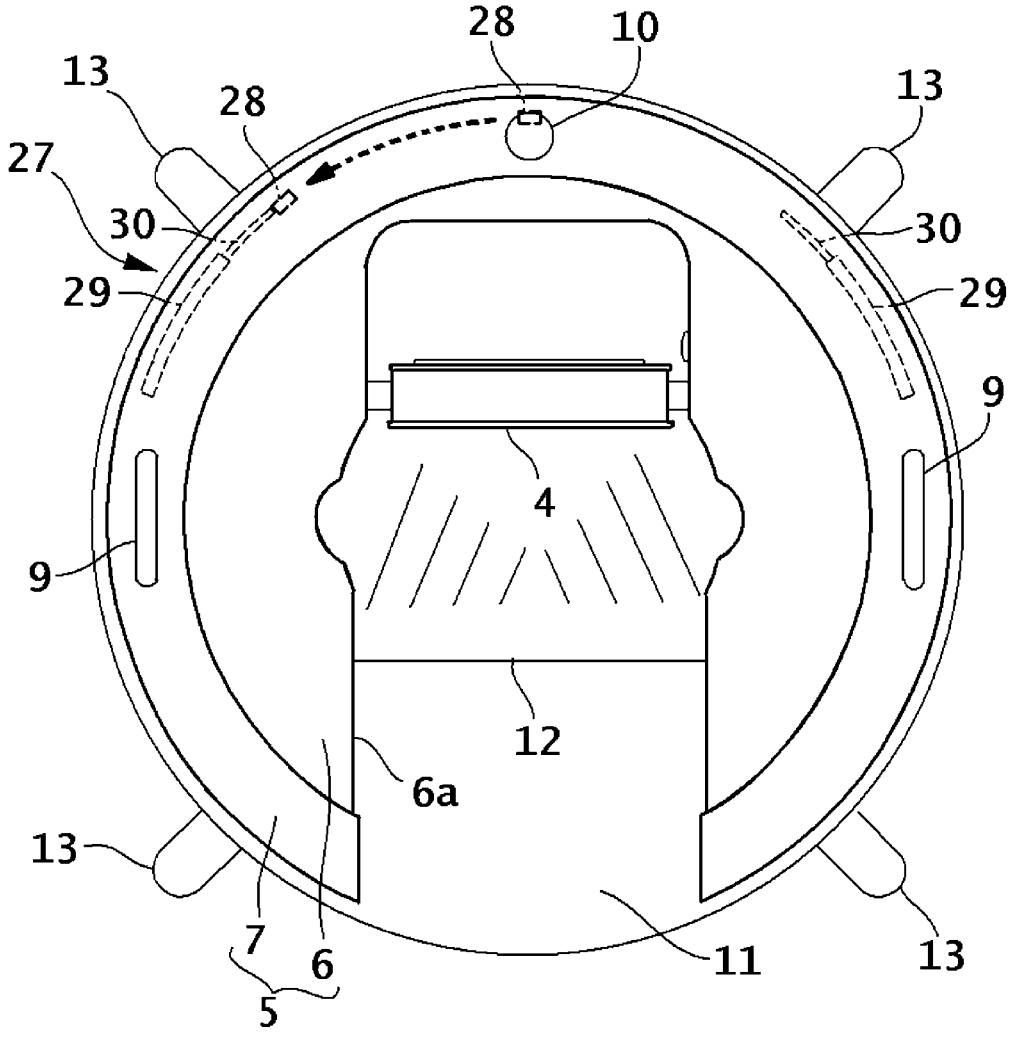
FIG. 11 is a view illustrating setting of the braking means illustrated in FIG. 10.

FIG. 11 is a view illustrating the setting of the braking means 27 illustrated in FIG. 10. As illustrated in FIG. 11, the protruding part 28 is set at a predetermined position close to the circumference of the rotary table 6, and the braking cylinder 29 is set at a position that is on a moving line of the protruding part 28 and is required to apply a braking force to the rotary table 6 (FIG. 8 illustrates, as a specific setting state, a configuration in which the protruding part 28 is provided on the lower surface of the rotary table 6, and the braking cylinder 29 is provided on a bottom surface of the housing 72). The protruding part 28 that moves along with the rotation of the rotary table 6 collides with a tip end of the rod section 30 protruding from the braking cylinder 29 fixed in the housing 72 to brake the rotation of the rotary table 6. When the compression coil spring in the braking cylinder 29 contracts by an appropriate length, the rotation of the rotary table 6 stops. Thus, due to the presence of the braking means 27, the rotation range of the rotary table 6 can be regulated. The braking means 27 is provided so as to prevent injuries and accidents caused by the excessive stretching of a human body resulting from the excessive rotary motion.

Figure 12:
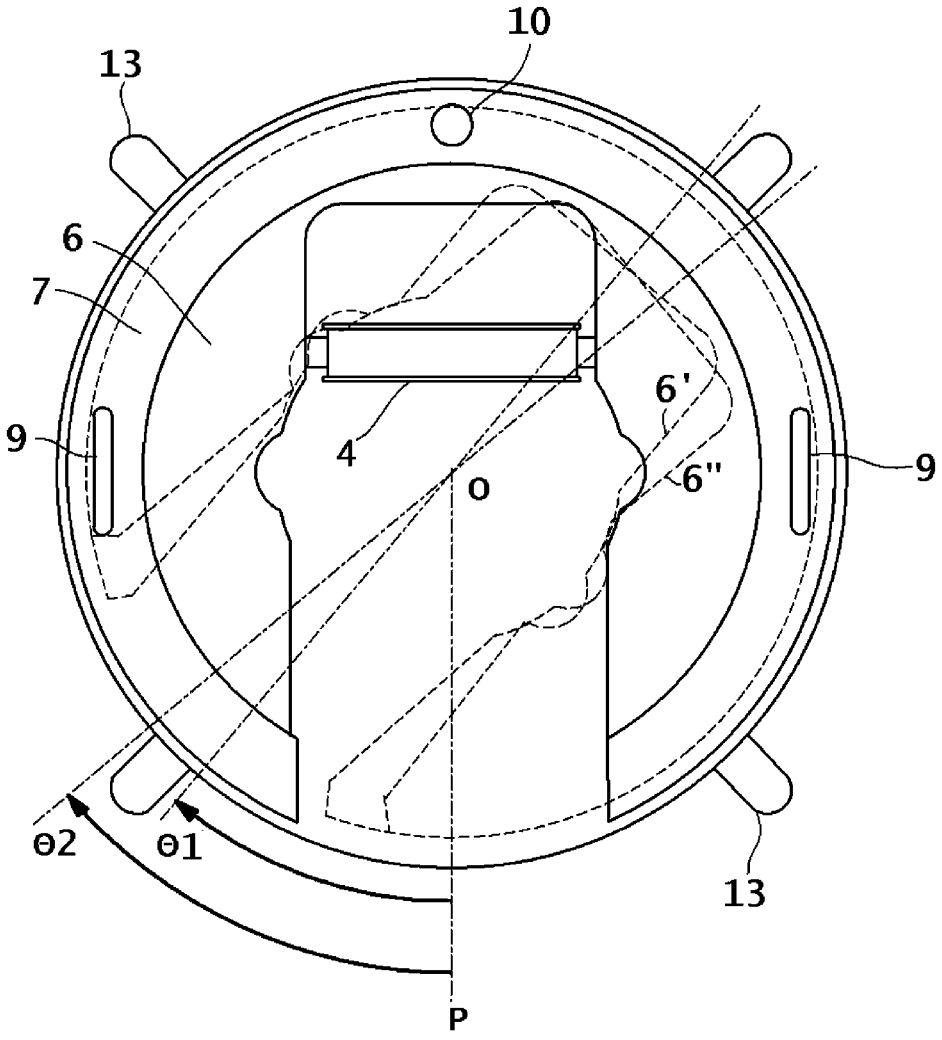
FIG. 12 is a view illustrating a rotation range of the rotary table.

FIG. 12 illustrates an example of the rotation range of the rotary table 6 in the case of using the braking means 27 illustrated in FIG. 10. As illustrated in FIG. 12, in the case of the rotation in a right direction, when the rotary table 6 rotates from the position before the rotation (in FIG. 12, position where the direction of the cut-out region 6*a* matches with the line segment OP indicated by the alternate long and short dash line) until a center line of the cut-out region 6*a* of the rotary table 6 moves by a rotation angle θ1, the protruding part 28 collides with the tip end of the rod section 30 of the braking cylinder 29. When the rotary table 6 further rotates by a rotation limit angle θ2 against the urging force of the spring in the braking cylinder 29, the rotary table 6 reaches a Detraction limit of the rod section 30 and cannot rotate any more. That is, the rotary table 6 can freely rotate from the position before the rotation to the rotation angle θ1. The rotation of the rotary table 6 is braked when the rotary table 6 rotates by more than the rotation angle θ1, and the rotary table 6 stops when reaching the rotation limit angle θ2. Herein, the rotation angle θ1 and the rotation limit angle θ2 can be set appropriately. As an example, the rotation angle θ1 of FIG. 12 can be set to about 40°, and the rotation limit angle θ2 of FIG. 12 can be set to about 50°.

Load adjusting means 10 for applying a load to the rotation of the rotary table 6 is further provided on the deep side (on the forward side) of the rotation table support means 7.

Figure 13A:
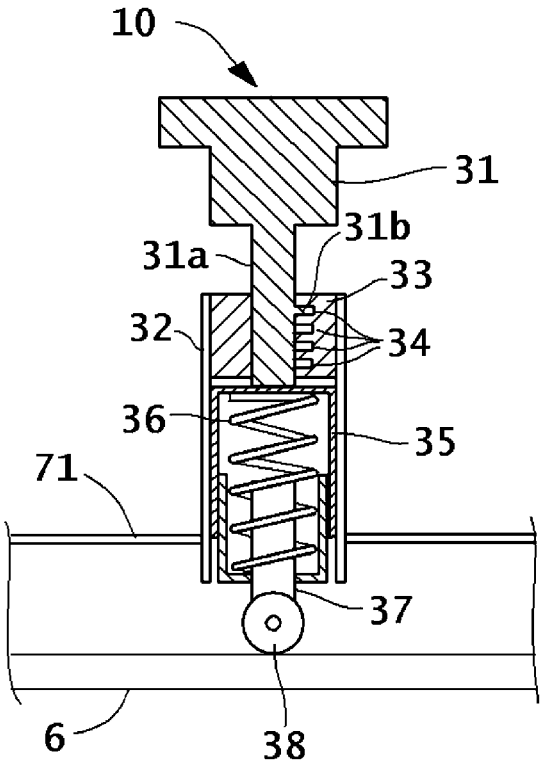
FIG. 13A is a side sectional view illustrating a state before load adjustment of an example of load adjusting means illustrated in FIG. 2.
Figure 13B:
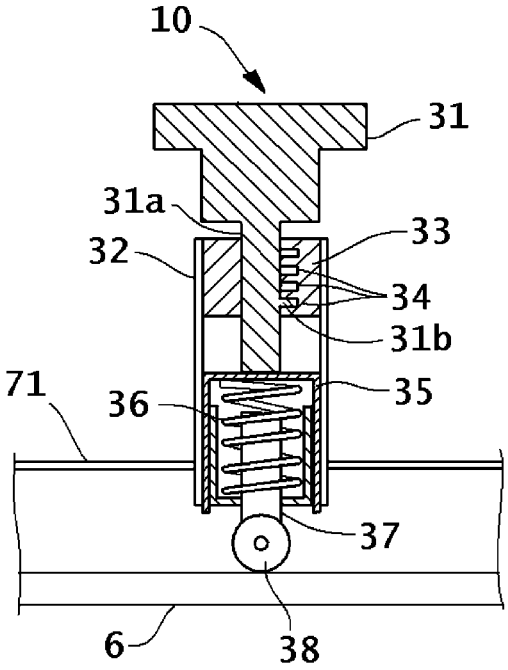
FIG. 13B is a side sectional view illustrating a state after load adjustment of an example of load adjusting means illustrated in FIG. 2.

FIGS. 13A and 13B are sectional views illustrating an example of the load adjusting means and an operation thereof. FIG. 13A illustrates a state before load adjustment, and FIG. 13B illustrates a state after load adjustment. The load adjusting means 10 in the example illustrated in FIGS. 13A and 13B includes a knob 31 and a case 32 fixed to the lid 71 of the rotary table support means 7 so as to pass therethrough. Note that, the mounting of the case 32 on the lid 71 is not particularly limited to such a configuration.

The knob 31 includes a shaft 31*a* to be accommodated in the case 32, and a pin 31b protruding in a direction orthogonal to an axial direction is formed at an intermediate position of the shaft 31*a*. Further, an opening into which the shaft 31*a* of the knob is inserted is formed at the center of an upper portion 33 in the case 32, and pin receiving sections 34 capable of receiving the pin at four height positions respectively are formed on an inner wall of the opening. The pin receiving sections 34 enable the load adjustment in 4 stages (the load adjustment is not limited to the 4 stages, and may be 3 stages or 5 or more stages). An inner cylinder 35, a spring 36, and a shaft support section 37 including a rotatable load bearing 38 in a lower end portion thereof are arranged in the stated order on a lower side of the upper portion 33 of the case. In the case of FIG. 13A, the load bearing 38 merely presses the rotary table 6 from above substantially without receiving an urging force of the spring 36. On the other hand, in the case of FIG. 13B, the knob 31 is pressed down, and the pin 31*b* is accommodated in the pin receiving section 34 on the lowermost side. In this state, the shaft 31*a* of the knob 31 presses down the inner cylinder 35 to cause the spring 36 to contract, and the load bearing 38 attempts to be restored to further press the rotary table 6, with the result that the rotary table 6 rotates under a load. Accordingly, the user H needs to perform a rotary motion while receiving stronger resistance, which enables more effective muscle training. Note that, a rotary wheel having the same function as that of the load bearing 38 can be substituted for the load bearing 38.

Hitherto, the training apparatus or exercise equipment configured so that the upper body or the lower body is twisted as described in Background Art adopts a method of a weight type, a plate type, a pneumatic type, or a hydraulic type so as to apply a load during the rotary motion. However, in the weight type, the plate type, and the pneumatic type, when the rotary motion is switched from the right direction to the left direction or from the left direction to the right direction, it is necessary to switch the application direction of a load with a load adjusting device. Therefore, there is also a problem in that the movement cannot be performed while a predetermined load is applied continuously during the rotary motion from the right direction to the left direction or from the left direction to the right direction. Further, a device adopting the hydraulic type also has a problem in that the load resistance is different in magnitude between the rotary motion in the right direction and the rotary motion in the left direction. In this embodiment, a load is applied by pressing the rotary table 6 with the load bearing 38 as described above, and hence it is not necessary to switch the application direction of a load. Further, there is an advantage in that, even when the rotary table 6 is rotated in any of the left and right directions, a similar load can be applied in stages to the rotary table 6 constantly. Note that, a part (or one) of a plurality of the bearings 20 described above may also be changed to the load bearing 38 of the load adjusting means 10 having the above-mentioned configuration. Further, this embodiment is not limited to the example of FIGS. 13A and 13B described above, and for example, it is also possible to employ a structure using the deformation of an elastic body such as a coil spring, a plate spring, or rubber (including both a structure of deforming the elastic body substantially in parallel with the rotation direction of the rotary table 6 and a structure of pressing the elastic body against the rotary table 6 directly or indirectly), a structure capable of applying a load electrically or electromagnetically, or the like.

Figure 5A:
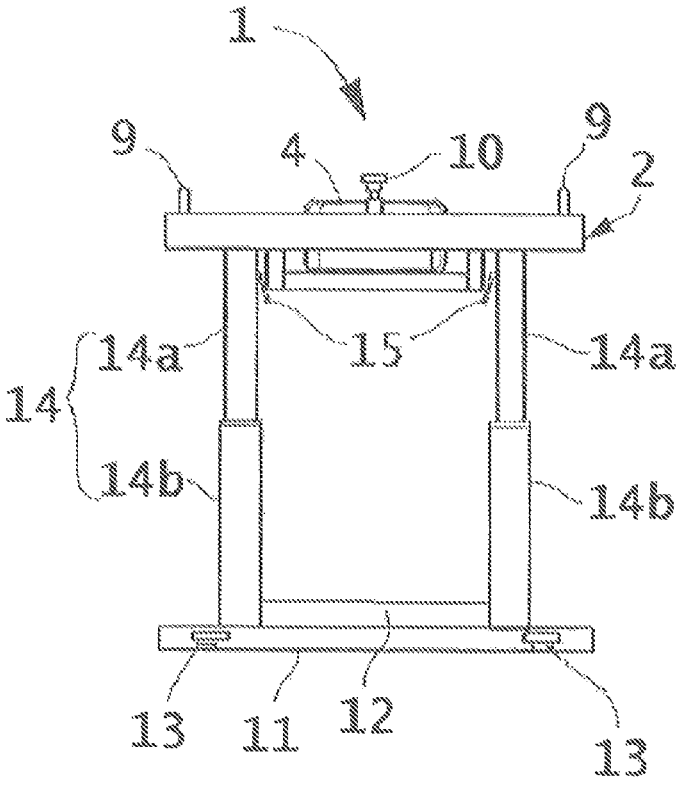
FIG. 5A is a front view of the embodiment illustrated in FIG. 2.
Figure 5B:
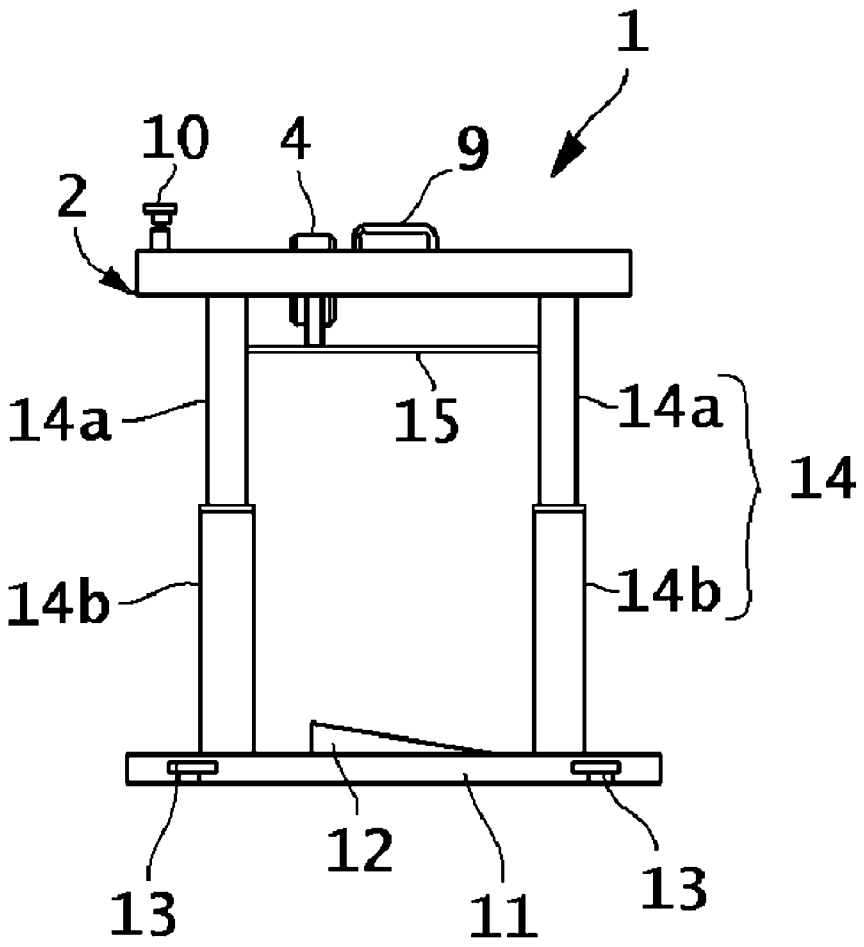
FIG. 5B is a side view of the embodiment illustrated in FIG. 2.
Figure 14A:
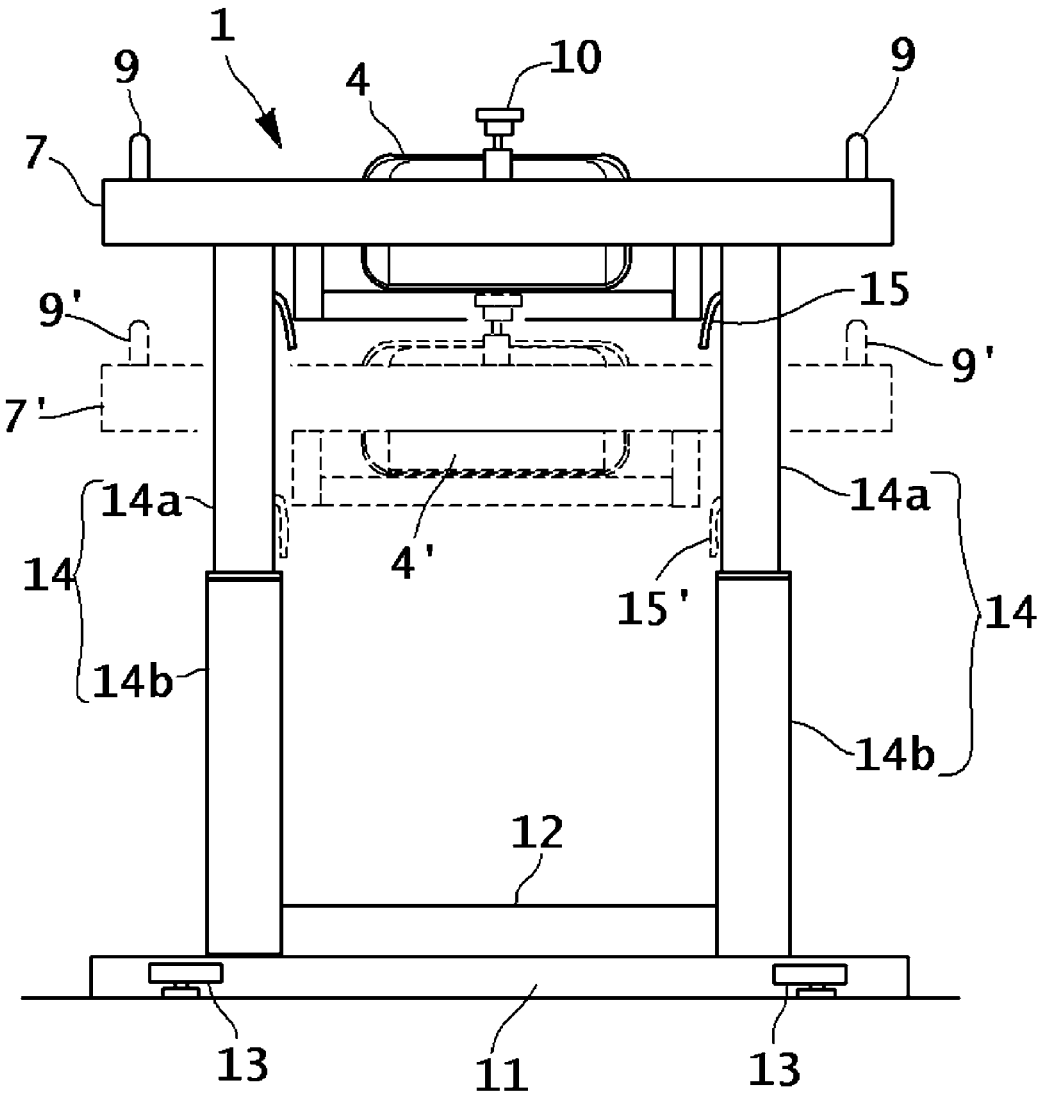
FIG. 14A is a front view of a lifting and lowering state of the rotary mechanism.
Figure 14B:
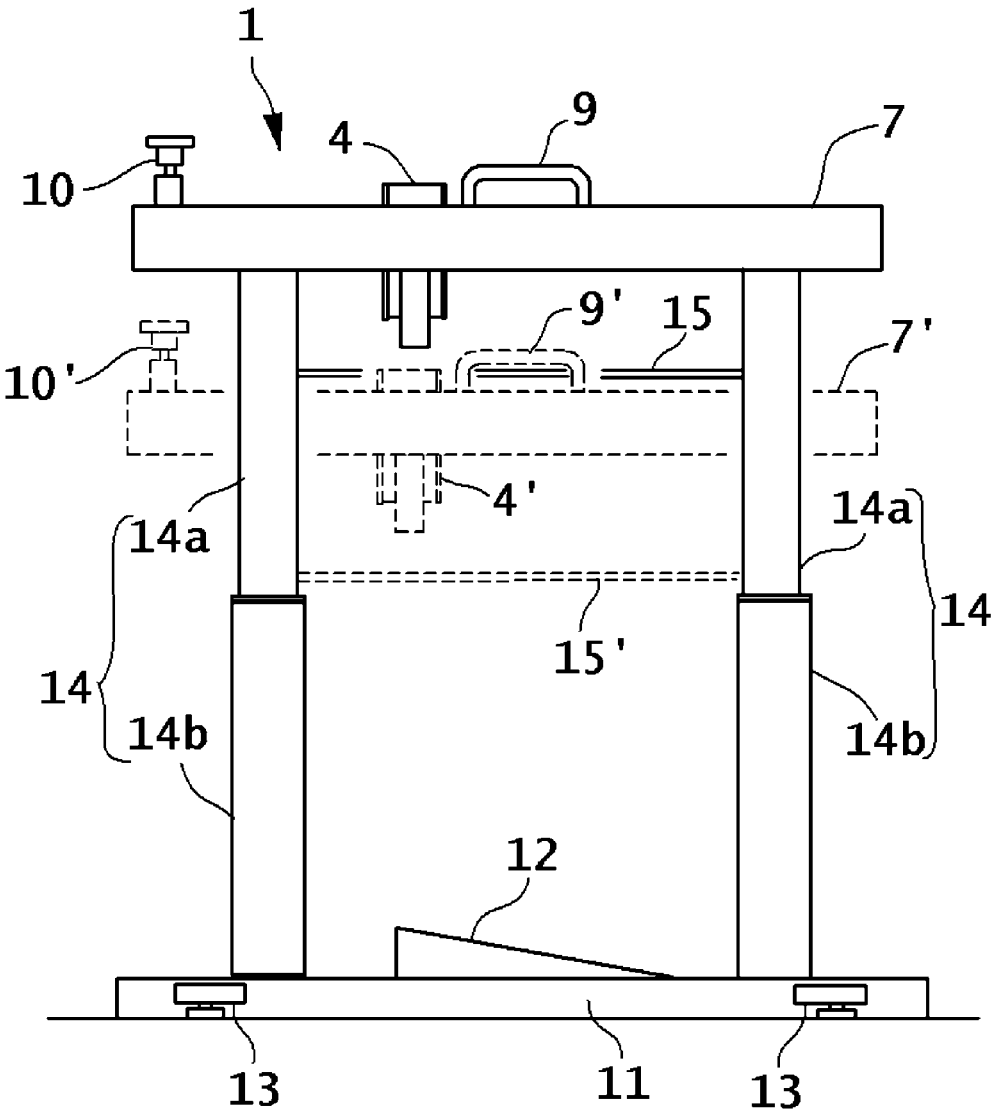
FIG. 14B is a side view of a lifting and lowering state of the rotary mechanism.

As illustrated in FIGS. 2, 5A and 5B, the rotary mechanism 5 is supported at a predetermined height with four support columns 14, 14, 14, 14 serving as support means. The four support columns 14, 14, 14, 14 are configured in such a manner that inner cylinders 14*a*, 14*a*, 14*a*, 14*a* fixed to a lower surface of the rotary table support means 7 at one end are inserted in a nested manner into outer cylinders 14*b*, 14*b*, 14*b*, 14*b*each having a lower end portion fixed to the base 11, and the inner cylinders 14*a*, 14*a*, 14*a*, 14*a* can be lifted and lowered with respect to the outer cylinders 14*b*, 14*b*, 14*b*, 14*b*, respectively (FIGS. 14A and 14B illustrates that the rotary table support means can be lifted and lowered between a position 7 and a position 7', for example).

The respective inner cylinders 14*a* are configured so as to be lifted and lowered with respect to the outer cylinders 14*b* as described above, with the result that the user H can move up and down (lift and lower) the pelvis-fixing means 4 to the height position of the ilium in accordance with the body height of the user H. In the case of this embodiment, the user H performs the lifting and lowering by operating a lifting and lowering lever 15. The support columns 14 cooperate with a lifting and lowering mechanism (not shown) and with the lifting and lowering lever 15 to define an adjustable height support structure capable of aligning the rotary mechanism by moving the rotary mechanism 5 vertically in parallel with the rotation center 3. Examples of a suitable lifting and lowering mechanism include a gas spring, a pneumatic cylinder, a hydraulic cylinder, a ratchet, and an electric actuator. Those publicly known related-art support columns that expand and contract can be used preferably by incorporating those lifting and lowering mechanisms in the support columns 14 and operating the lifting and lowering lever 15. Note that, the number of the support columns and the arrangement thereof can be set appropriately, and are not limited to this embodiment. Further, the shape of the lifting and lowering lever 15 is not particularly limited to the illustrated shape. A foot switch, a button, or the like can also be substituted for the lifting and lowering lever 15.

Returning back to FIG. 4, the base 11 is a short columnar body having a substantially circular shape in a plan view. As described above, the lower end portions of the support columns 14, 14, 14, 14 (outer cylinders 14*b* , 14*b* , 1*b* , 14*b*) are fixed to portions close to the circumference of the surface of the base 11, and an inclined foot rest 12 is provided in a center region of the base 11. The inclination angle of the inclined foot rest 12 can be set so as to he adjusted continuously or intermittently within an angle range that can be set appropriately such as a range of from 0° to 25°. In the case of a configuration in which the inclination angle is adjusted intermittently, it is preferred that the inclination angle be adjusted, for example, in three stages of 5°, 10°, and 15° (the setting angle and the number of stages can be set appropriately). An inclined surface of the inclined foot rest 12 is provided with a foot direction indication 12*a* for calling the attention of the user H to the foot direction so that the user H can turn both the feet inwardly into a pigeon-toed state. The user H can perform the muscle training more effectively by providing the inclined foot rest 12 and the foot direction indication 12*a* as described above. Note that, effective muscle training of the user H is possible even when any one of the inclined foot rest 12 and the foot direction indication 12*a* is provided.

Overturning prevention devices 13, 13, 13, 13 are provided at four positions of a side surface of the base 11 at an equal interval in a circumferential direction. Further, a publicly known horizontal adjustment device for setting the training apparatus of this embodiment horizontally is provided on a lower side of the overturning prevention devices 13, 13, 13, 13. Note that, the number and arrangement of the overturning prevention devices 13 are not limited to the illustrated example and can be set appropriately.

[Second Embodiment]

Figure 15:
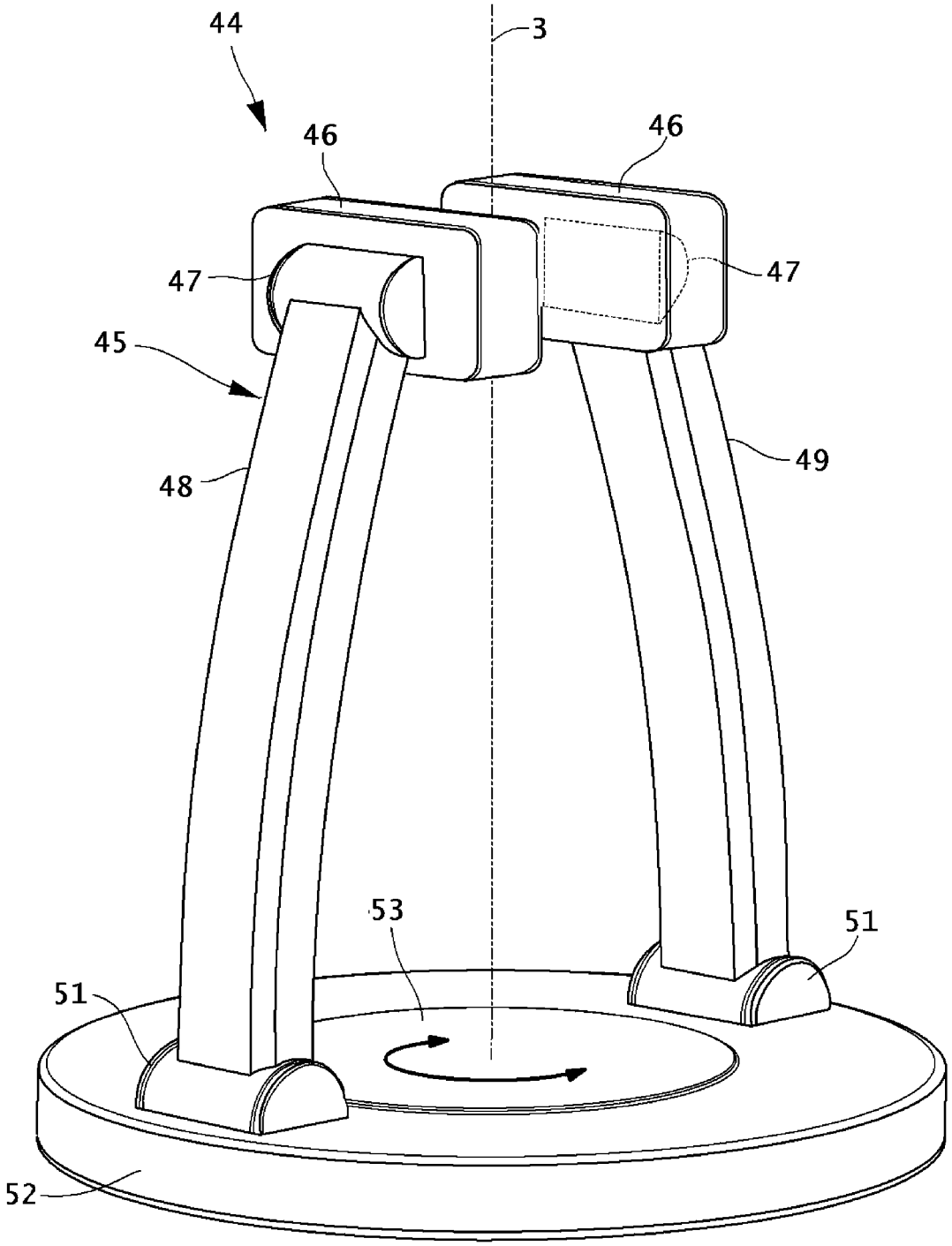
FIG. 15 is a perspective view illustrating a training apparatus according to a second embodiment of the present invention.

FIG. 15 is a perspective view illustrating a training apparatus according to a second embodiment of the present invention. The apparatus 44 of this embodiment illustrated in FIG. 15 includes a base 52 having a rotary table 53 at the center of an upper surface thereof, connecting sections 51, 51 provided on the upper surface so as to interpose the rotary table 53 therebetween, arms 48, 49 that stand from the upper surface through intermediation of the respective connecting sections 51, 51 so as to be opposed to each other and that are rockable in one direction, connecting sections 47, 47 respectively provided in upper end portions of the arms 48, 49 (the foregoing configuration corresponds to rotary mechanism support means 45), and pelvis-fixing means 46, 46 connected to the arms 48, 49 through intermediation of the respective connecting sections 47, 47 so as to be rockable in one direction due to the foregoing configuration. The training apparatus 44 of this embodiment is different from the first embodiment in which single pelvis-fixing means 4 is configured to rotate, in that the pelvis of the user H is fixed with a pair of the pelvis-fixing means 46, 46 at the respective tip ends of the arms 48, 49 and the rotary table 53 provided on the base 52 is rotated.

The rotary table 53 is configured so as to rotate in the right direction and in the left direction. It is preferred that the rotary mechanism of the rotary table 53 include publicly known various load adjusting means for adjusting such a load to be applied to the rotation and publicly known various braking means for regulating the rotation range. Due to the application of a load, more effective training of the trunk and the muscles surrounding the area from the pelvis to the hip joint of the user H can be performed, and the injuries and accidents caused by the excessive stretching of a human body by the excessive rotary motion can also be prevented.

A pair of the arms 48, 49 opposed to each other rotate so as to move toward and away from each other by the connecting sections 51, 51 capable of rotating in one direction. Note that, although not shown, it is preferred that an intermediate region in a length direction of each of the arms 48, 49 be configured so as to expand and contract. Thus, the total length of the arms 48, 49 can be adjusted, and thus the height position of the pair of the pelvis-fixing means 46, 46 can be changed in accordance with the body height of the user H. That is the pelvis-fixing means 46, 46 can be moved up and down.

The pair of the pelvis-fixing means 46, 46 can have an outer shape and a structure similar to those of the above-mentioned embodiment. Further, one of the pair of the pelvis-fixing means 46, 46 can be provided with the upper body support section (not shown) in the above-mentioned embodiment (see reference numerals 41, 42 of FIG. 6). Accordingly, during the rotary motion, the user H can prevent the rectangle ABCD illustrated in FIG. 1 from being deformed more reliably and can also suppress the deviation of the center axis of the body of the user H from the rotation center 3 during the rotary motion of the upper body including the pelvis (lower abdomen and waist). Therefore, more effective muscle training of a predetermined part can be performed.

[Third Embodiment]

Figure 16:
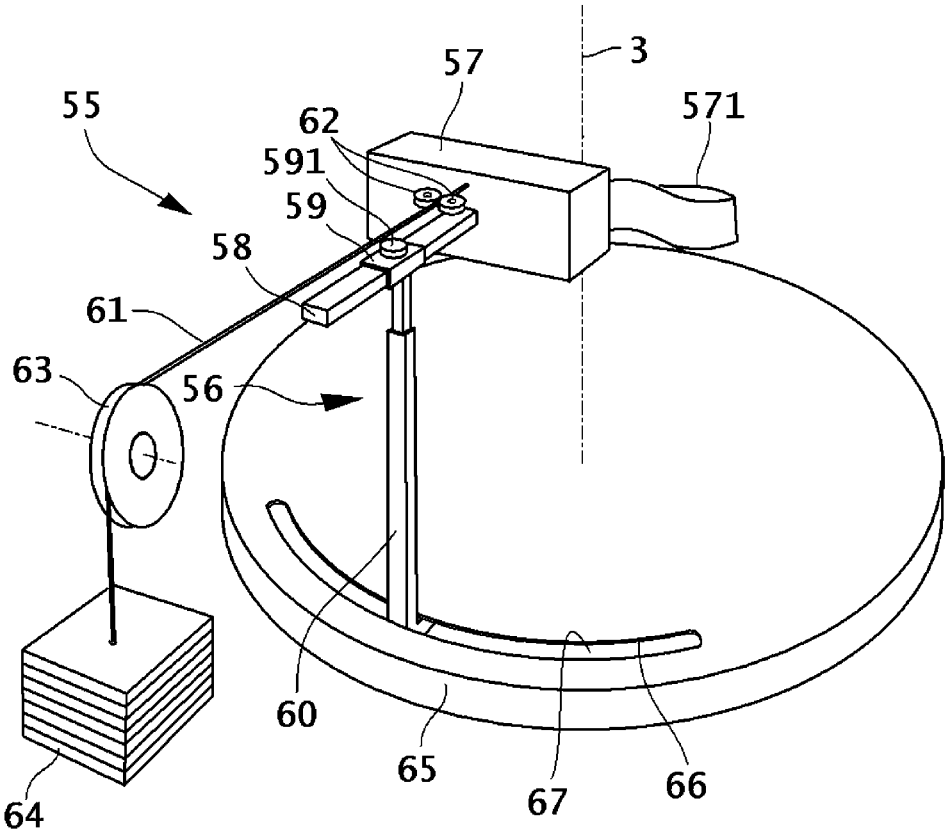
FIG. 16 is a perspective view illustrating a training apparatus according to a third embodiment of the present invention.
Figure 17:
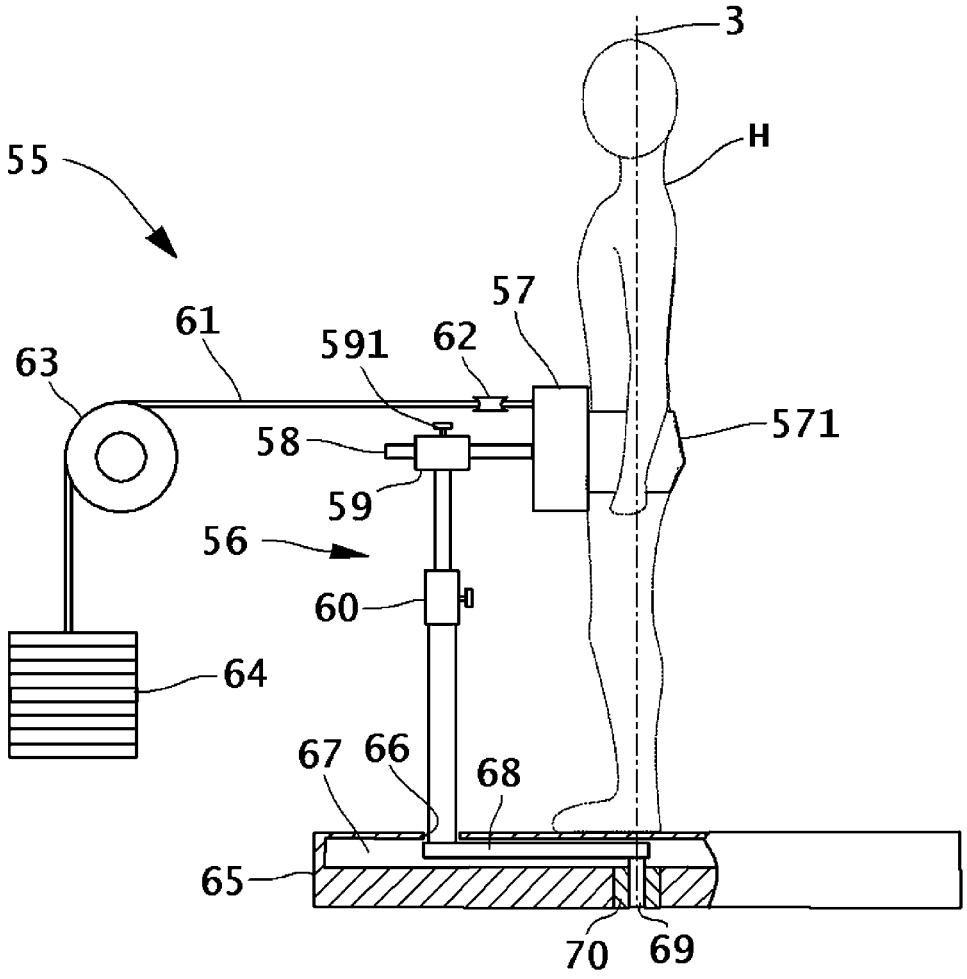
FIG. 17 is a view illustrating a use state of the embodiment illustrated in FIG. 16.

FIG. 16 is a perspective view illustrating a training apparatus according to a third embodiment of the present invention, and FIG. 17 is a view illustrating a use state thereof. As illustrated in FIGS. 16 and 17, a training apparatus 55 of this embodiment includes pelvis-fixing means 57 including a band-shaped fastening member 571, and rotary mechanism support means 56 for supporting the pelvis-fixing means 57 so that the pelvis-fixing means 57 is rotatable about a rotation center 3 and can be adjusted in position in an up-and-down direction. The rotary mechanism support means 56 includes a rotary shaft 69 erected so as to rotate in a rotary mechanism accommodating chamber 67 in a base 65 about the rotation center 3 by a shaft support section 70, a horizontal member 68 including one end portion fixed to an upper end of the rotary shaft 69 and extending in a direction substantially orthogonal to the rotation shaft 69, a support column 60 erected perpendicularly to the horizontal member 68 from a portion close to the other end of the horizontal member 68 toward outside of the rotary mechanism accommodating chamber 67 through an arc-shaped long hole 66, a guide section 59 having a square tube shape provided at an upper end of the support column 60, and a stay 58 provided in an opening of the guide section 59 so as to move in a direction of the opening. The guide section 59 is only required to have a tubular shape, and the shape of the guide section 59 is not limited to the above-mentioned square tube shape. In this embodiment, a combination of the guide section 59 and the stay 58 enabling the pelvis-fixing means 57 to move toward and away from the rotation center 3 forms a slide movement mechanism. The slide movement mechanism is included in the rotary mechanism support means 56.

The stay 58 is a square bar extending substantially perpendicularly from the center of a back surface of the pelvis-fixing means 57. The outer shape of the stay 58 is not limited to the above-mentioned configuration and can be appropriately changed in accordance with the shape of a cross section of the opening of the guide section 59. The guide section 59 is fitted onto the stay 58. The slide movement of the stay 58 and further the pelvis-fixing means 57 in the direction of the opening of the guide section 59 can be performed or can be regulated by operating a knob 591 of the guide section 59. A publicly known related-art structure can be used as the guide section 59 without any particular limitation. Further, the support column 60 has a structure capable of expanding and contracting by including an outer cylinder and an inner cylinder that can be accommodated in the outer cylinder in a nested manner. Thus, the pelvis-fixing means 57 can be lifted and lowered in an up-and-down direction to be aligned with the height position of the ilium of the user H (lifting and lowering mechanism). Note that, two poles as denoted by reference numerals 41 and 42 in FIG. 6 may be provided as upper body support sections on an upper surface of the pelvis-fixing means 57.

In this embodiment, with such a structure, the pelvis-fixing means 57 can rotate along with the rotation of the rotary shaft 69. Although the rotation range of the pelvis-fixing means 57 is determined based on the length of an arc of the arc shaped long hole 66 of the base 65, for example, it is preferred that the rotating support column 60 be prevented from colliding with the end portion of the arc-shaped long hole 66 through use of a device such as the braking means 27 in the first embodiment. Further, as illustrated in FIGS. 15 and 17, as the load adjusting means, means obtained by connecting one end of a wire 61 to a portion close to the upper end of the center of the back surface of the pelvis-fixing means 57 and connecting the other end of the wire 61 to a weight 64 through a pair of pulleys 62, 62 and a pulley 63 arranged midway between the pulleys 62, 52 and the weight 64 can be used. Due to the load adjusting means, even in the case where the user H rotates the upper body including the pelvis (lower abdomen and waist), a similar load can be applied without switching the application direction of a load to any of the right direction and the left direction when viewed from the user H. Note that, the load adjusting means is not limited to such an example, and a publicly known related-art structure can be used.

In the case of using a training apparatus 55 of this embodiment, as illustrated in FIG. 17, the user H adjusts the weight of the weight 64 in the load adjusting means in advance. Then, the user H takes standing posture and causes the center axis of the body to substantially match with the rotation center 3. Under this condition, the user H presses the pelvis-fixing means 57 against the height position of the ilium by operating the knob 591 of the guide section 59. Concurrently, the user H fastens the band-shaped fastening member 571 to bring the height position of the ilium into close contact with the pelvis-fixing means 57. Then, the user H rotates the upper body including the pelvis (lower abdomen and waist) in the right direction and in the left direction so as not to deform the rectangle ABCD (see FIG. 1) illustrated in FIG. 1 or deviate the center axis of the body of the user H from the rotation center 3 during the rotary motion of the upper body including the pelvis (lower abdomen and waist) The effective muscle training can be performed by repeating this movement.

[Fourth Embodiment]

Figure 18:
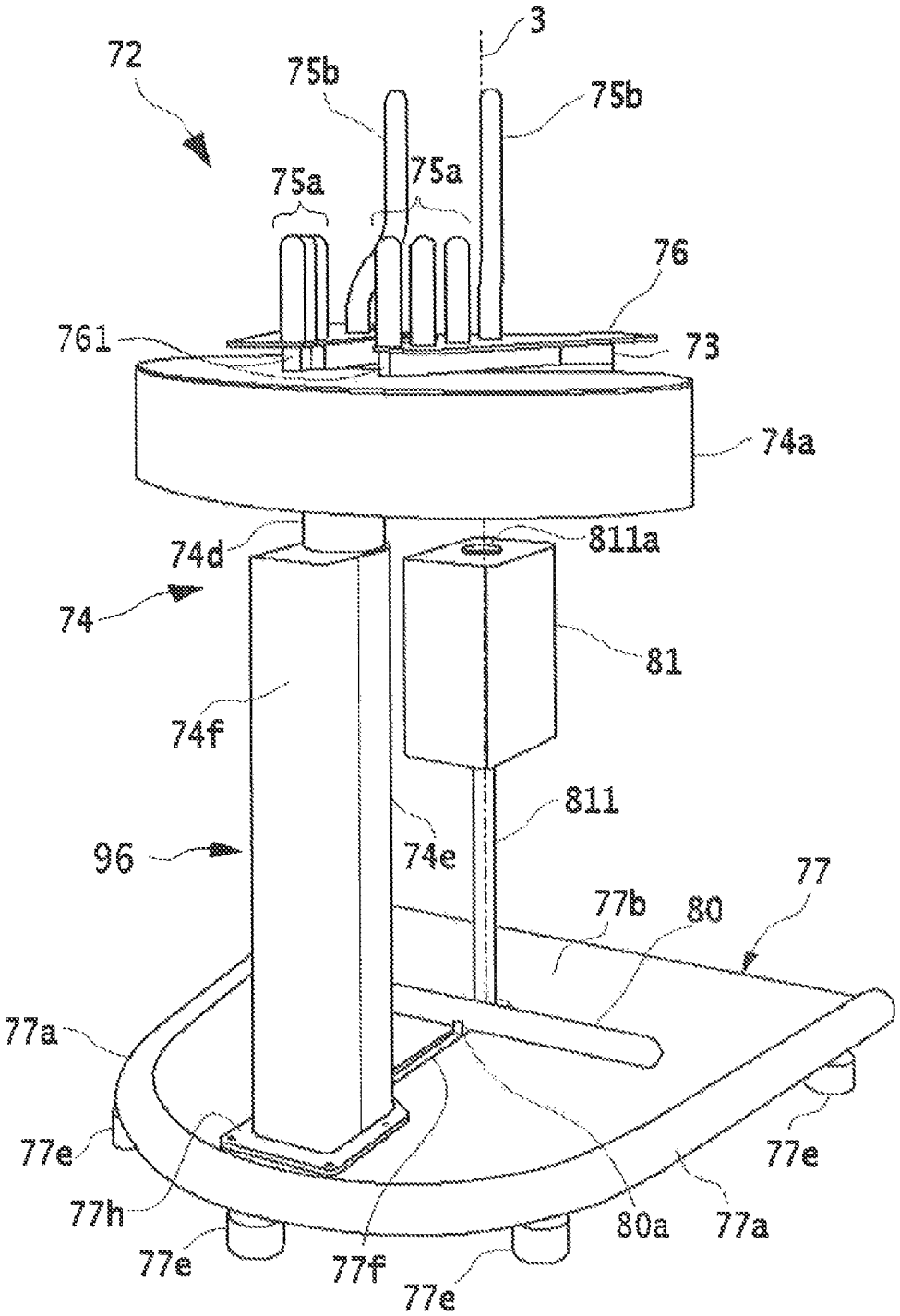
FIG. 18 is a perspective view illustrating a training apparatus according to a fourth embodiment of the present invention.
Figure 19:
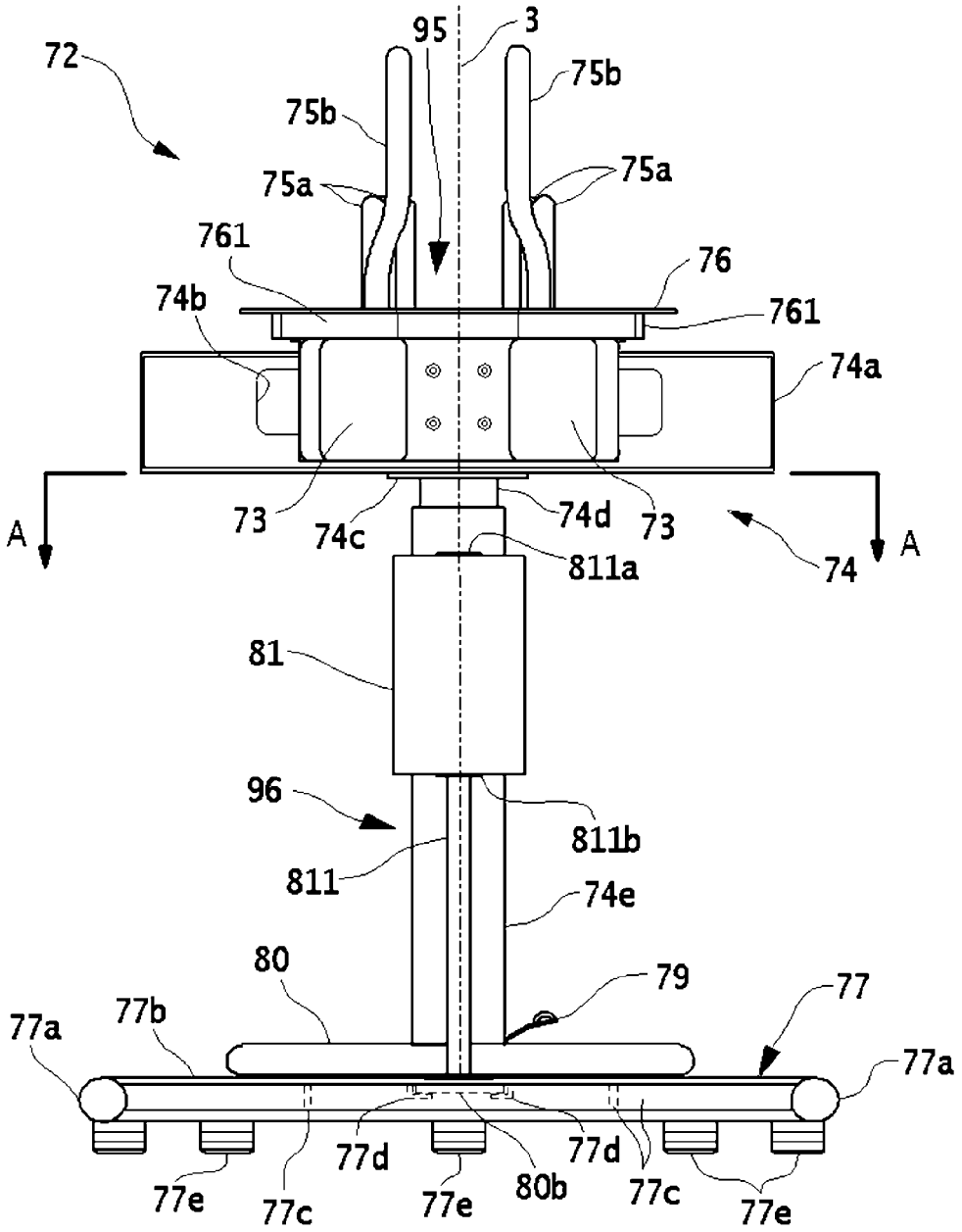
FIG. 19 is a front view of the embodiment illustrated in FIG. 18.
Figure 20:
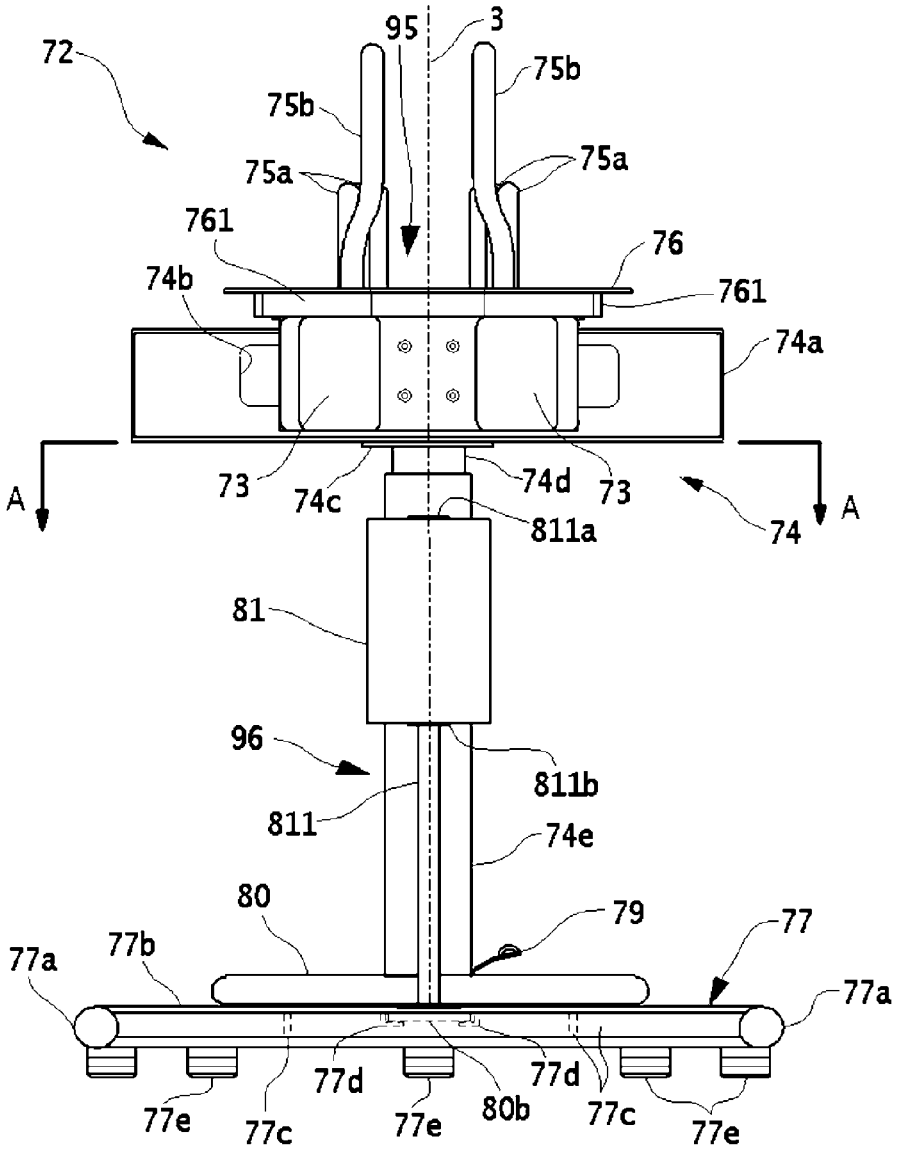
FIG. 20 is a rear view of the embodiment illustrated in FIG. 18.
Figure 21:
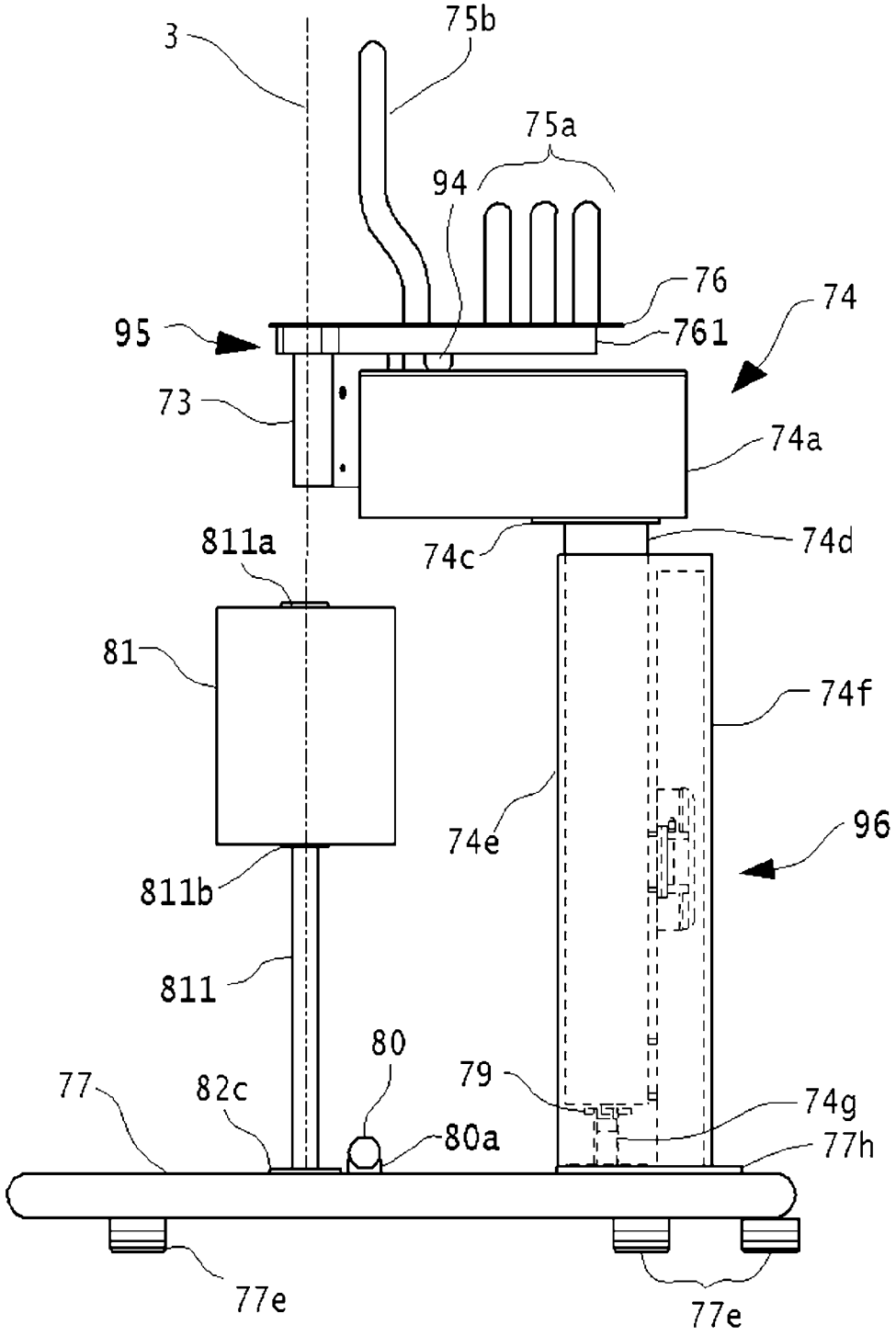
FIG. 21 is a left side view of the embodiment illustrated in FIG. 18.
Figure 22:
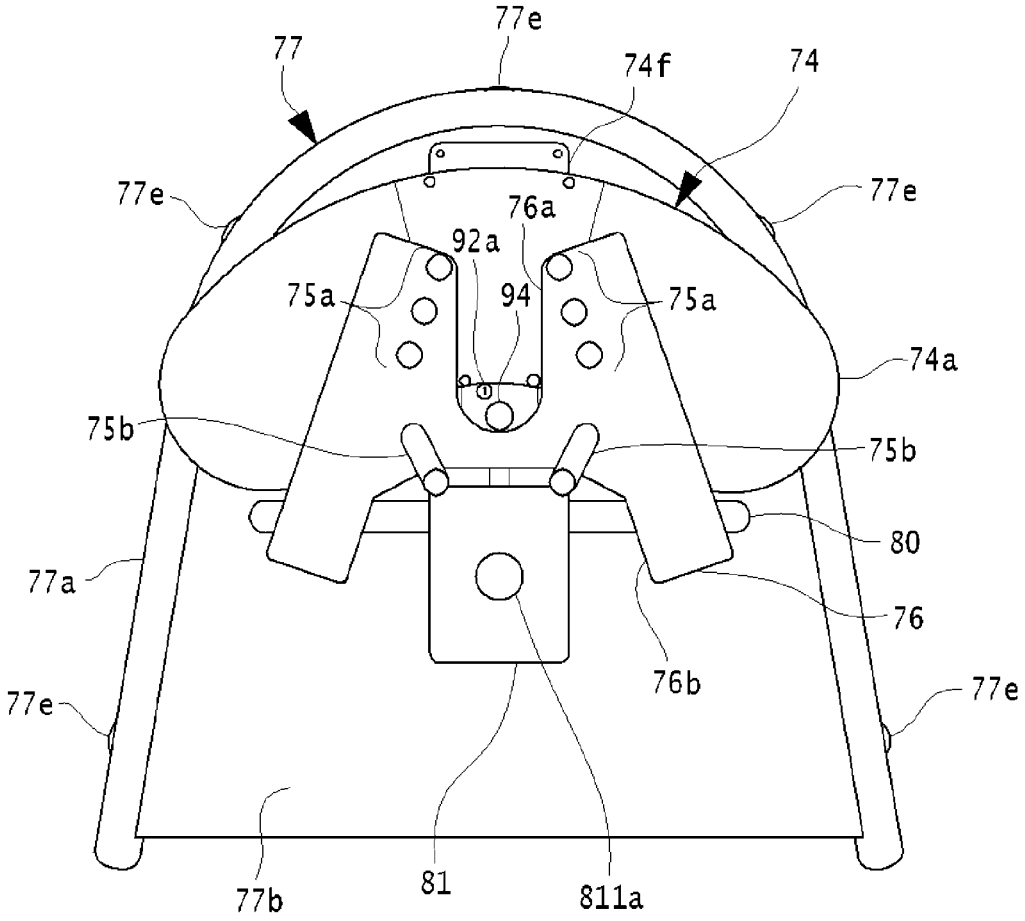
FIG. 22 is a plan view of the embodiment illustrated in FIG. 18.
Figure 23:
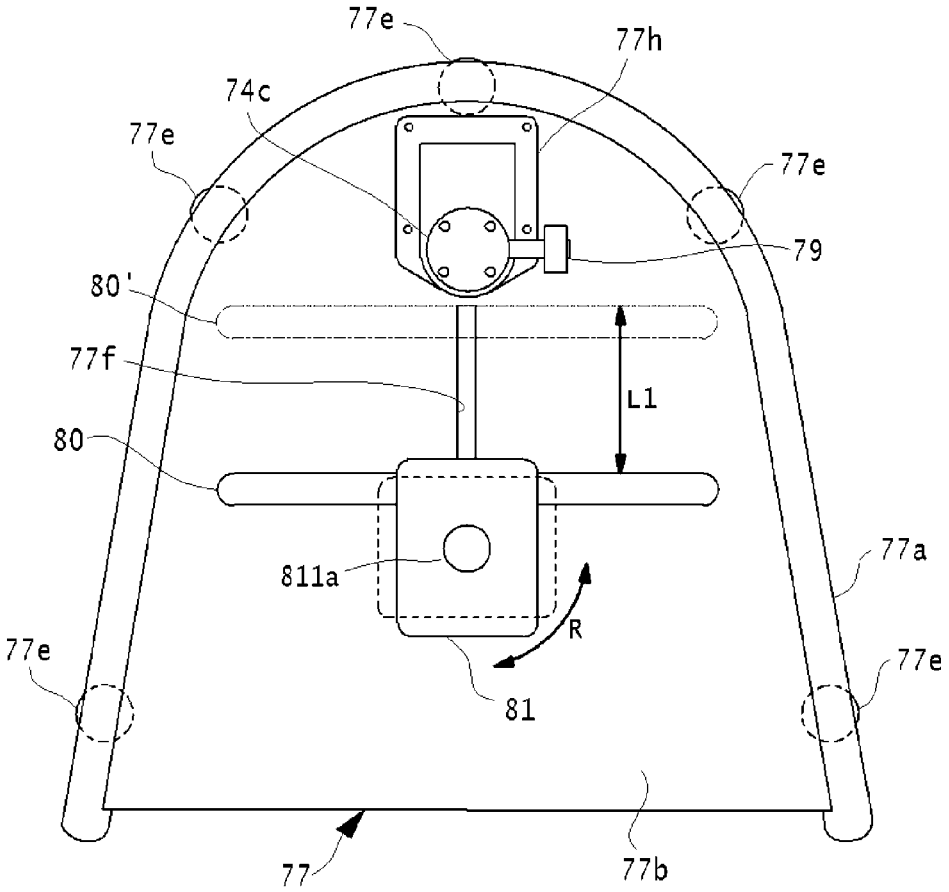
FIG. 23 is a view taken along the line indicated by the arrows A-A of FIG. 20.
Figure 24A:
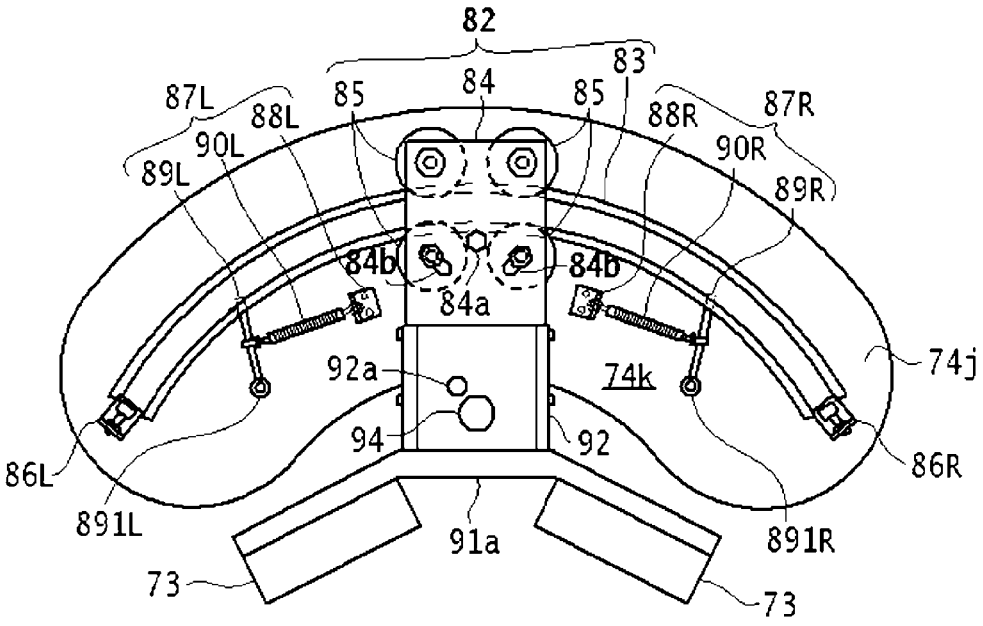
FIG. 24A is a view illustrating a configuration and an operation of an example of a rotary mechanism of the fourth embodiment.
Figure 24B:
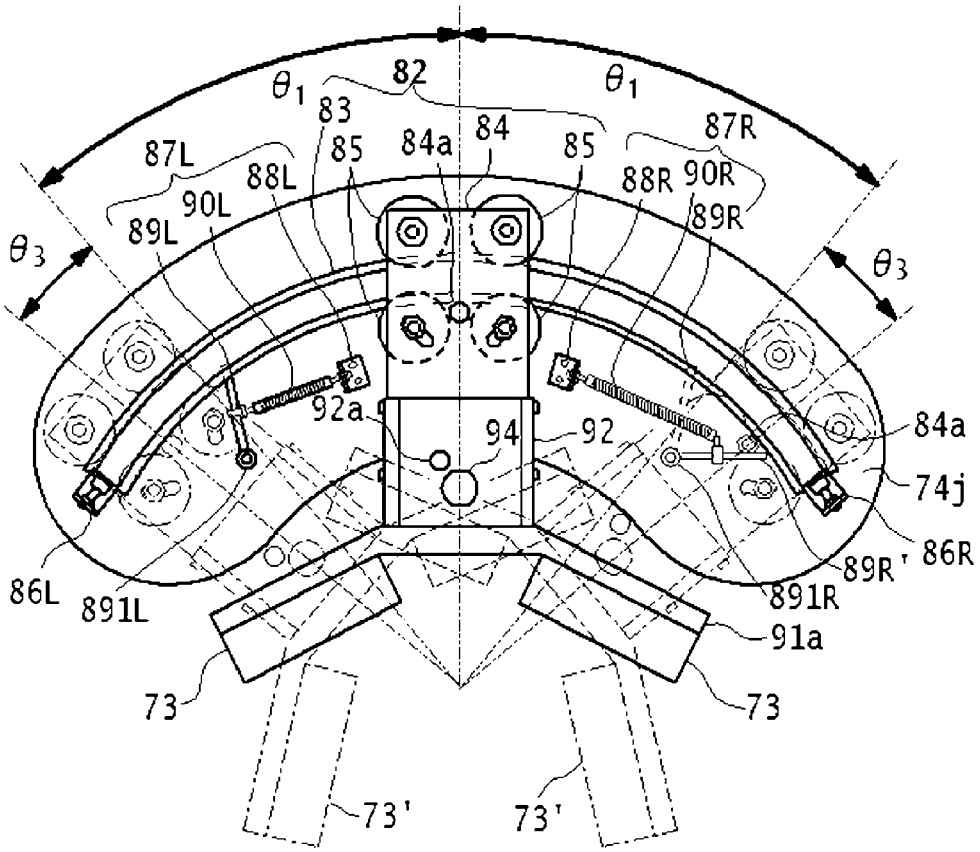
FIG. 24B is an explanatory view illustrating an operation of an example of a rotary mechanism of the fourth embodiment.
Figure 25A:
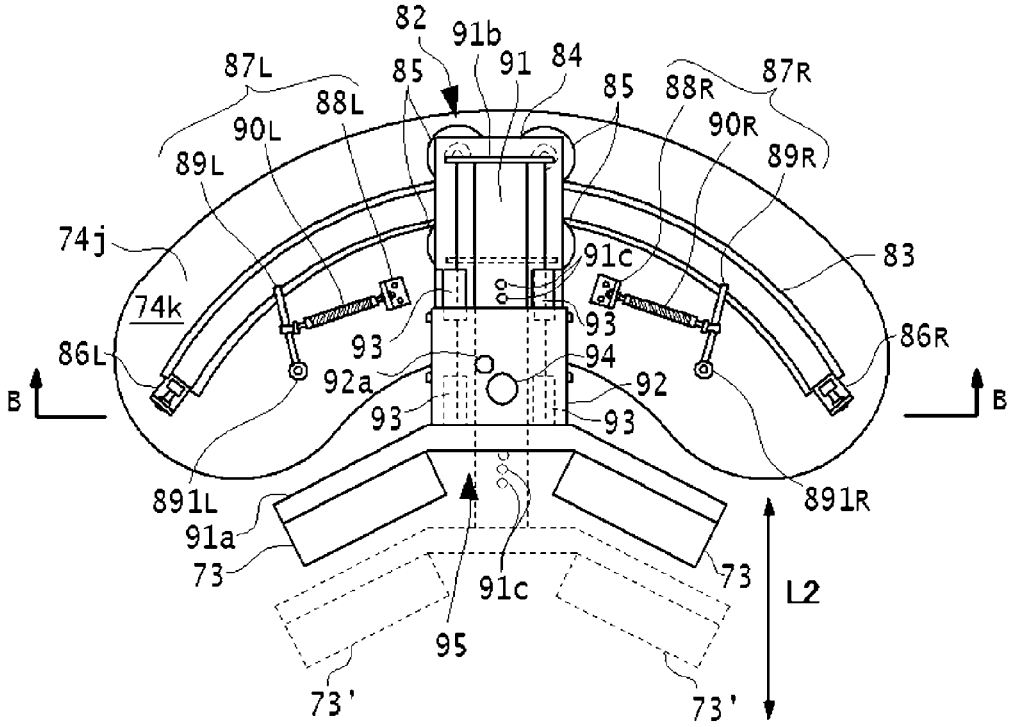
FIG. 25A is a plan view illustrating a configuration and an operation of an example of a slide mechanism of the fourth embodiment.
Figure 25B:
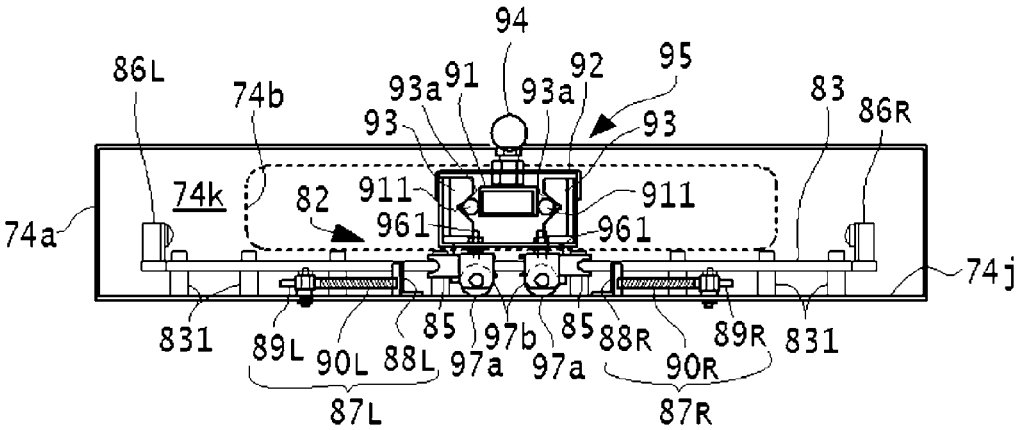
FIG. 25B is a front sectional view illustrating a configuration and an operation of an example of a slide mechanism of the fourth embodiment.
Figure 26:
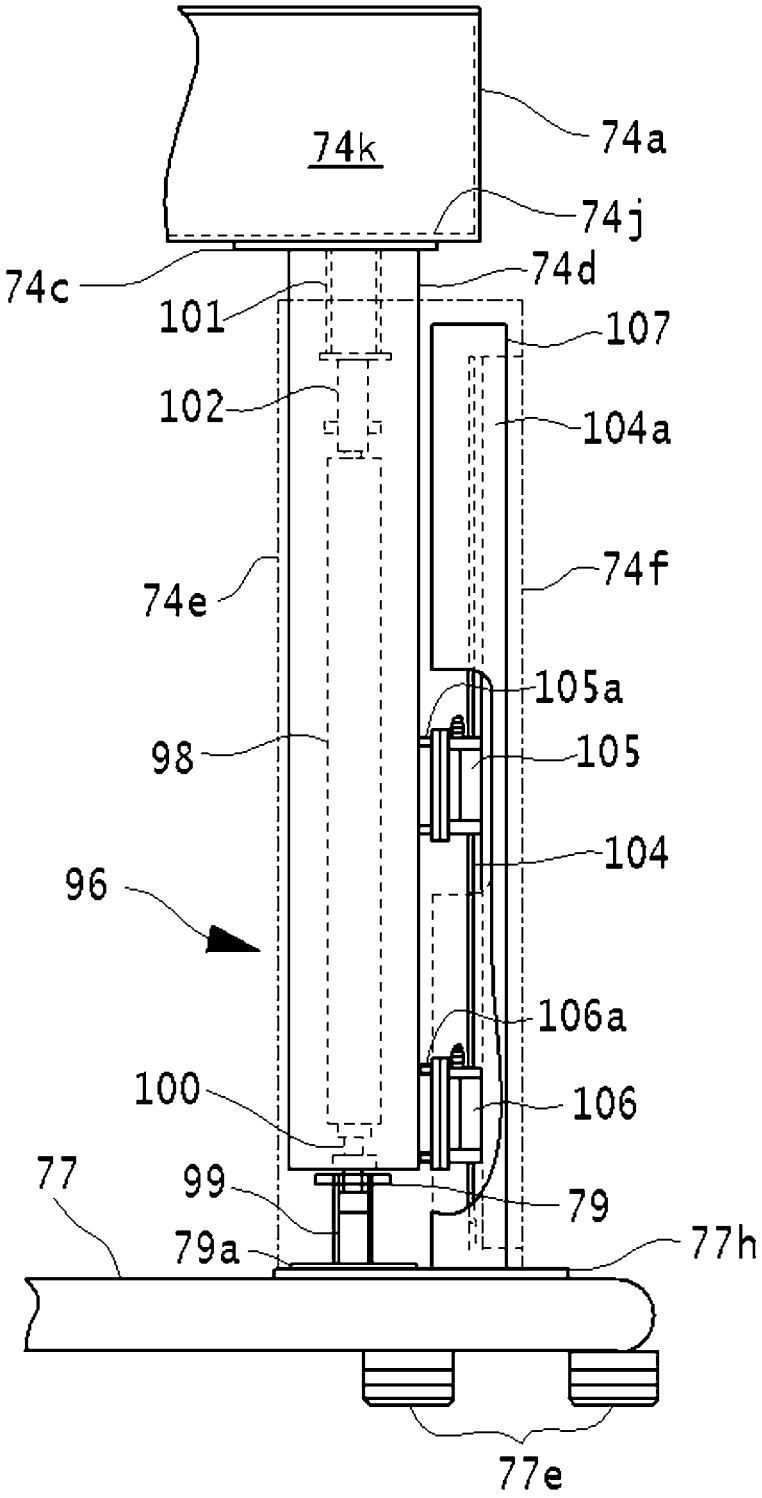
FIG. 26 is a partial side sectional view illustrating a configuration of an example of a lifting and lowering mechanism of the fourth embodiment.
Figure 27A:
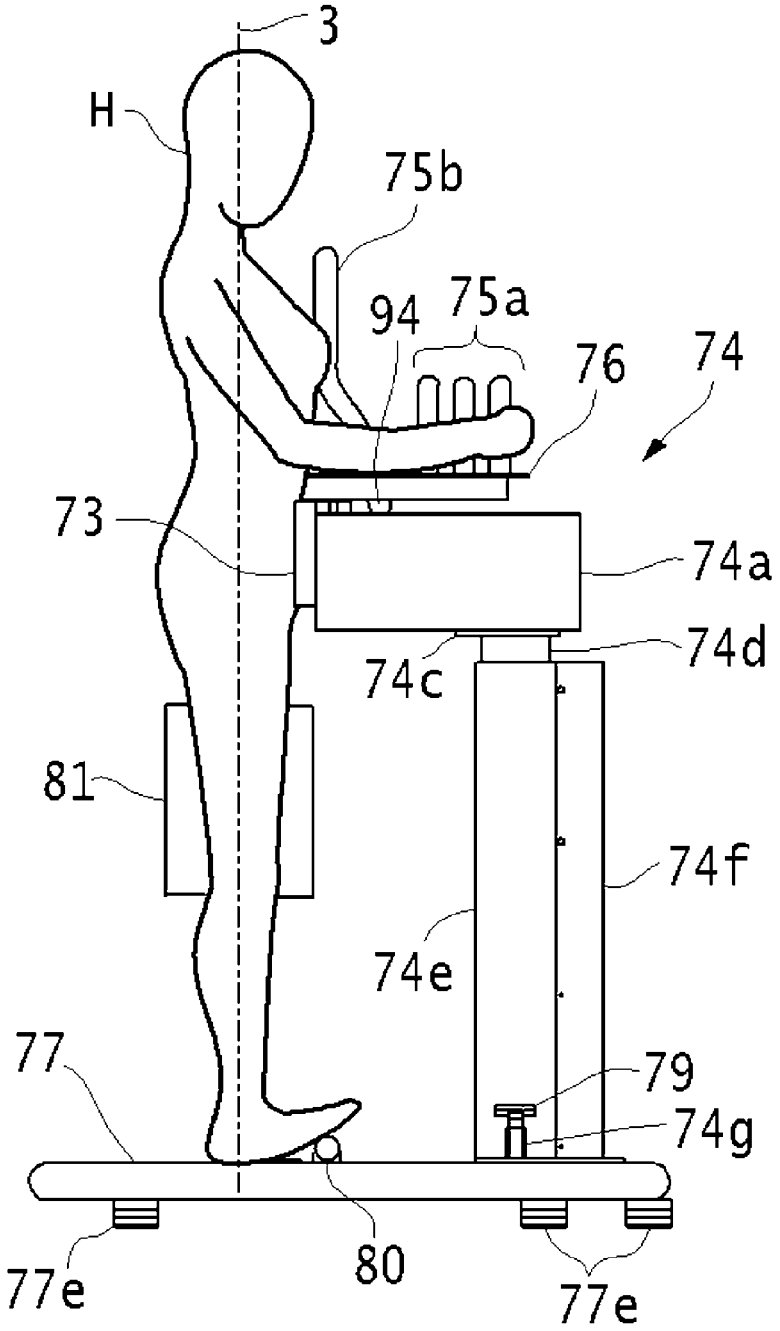
FIG. 27A is a view illustrating an example of a use state of the fourth embodiment.
Figure 27B:
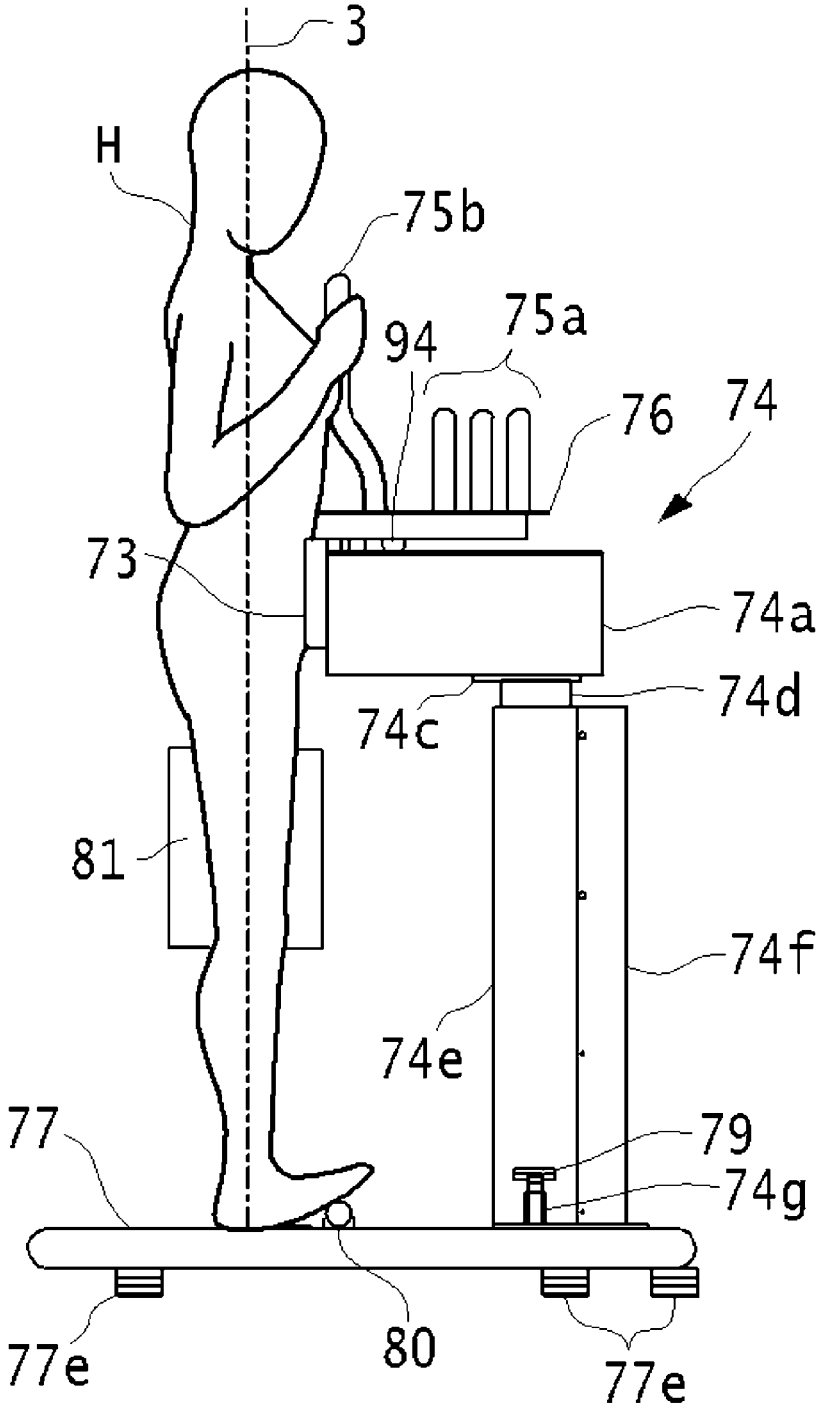
FIG. 27B is a view illustrating another example of a use state of the fourth embodiment.

FIG. 18 is a perspective view illustrating a training apparatus according to a fourth embodiment of the present invention. Further, FIG. 19 is a front view thereof, FIG. 20 is a rear view thereof, FIG. 21 is a left side view thereof, FIG. 22 is a plan view thereof, and FIG. 23 is a view taken along the line indicated by the arrows A-A of FIG. 20. Further, FIGS. 24A and 24B illustrate a configuration and an operation of an example of a rotary mechanism of this embodiment. FIG. 24A is a plan view illustrating the configuration thereof, and FIG. 24B is an explanatory view of the operation (rotation range) thereof. Further, FIGS. 25A and 25B illustrate a configuration and an operation of an example of a slide mechanism. FIG. 25A is a plan view illustrating the configuration thereof, and FIG. 25B is a front sectional view thereof. Further, FIG. 26 is a partial side sectional view illustrating a configuration of an example of a lifting and lowering mechanism. Further, FIGS. 27A and 27B are views illustrating a use state example of the fourth embodiment. FIGS. 27A and 27B illustrate an example of a variation of an upper support section that can be selected by the user H. Herein, in the description of this embodiment, for convenience, the term "slide mechanism" is used as a generic term including components serving to move the pelvis-fixing means toward and away from the rotation center and a component group belonging to the components, and the term "lifting and lowering mechanism" is used as a generic term including components serving to move up and down the rotary mechanism and the slide mechanism and a component group belonging to the components. The configurations of the respective mechanisms are described later.

As illustrated in FIGS. 18 to 26, a training apparatus 72 of this embodiment manly includes pelvis-fixing means 73, 73, rotary mechanism support means 74 erected from a base 77 and supporting the pelvis-fixing means 73, 73 so that the pelvis-fixing means 73, 73 are rotatable and can be aligned with the height position of the ilium of the user H, and a rotator section 81 provided in an upper end portion of a support shaft 811 arranged in a vertical direction so as to be concentric with the rotation center 3 similarly on the base 77. First, the rotary mechanism support means 74 is hereinafter described.

In this embodiment, the rotary mechanism support means 74 includes a rotary mechanism 82 for rotating the pelvis-fixing means 73, 73 about the rotation center 3, a slide mechanism 95 for moving the pelvis-fixing means 73, 73 toward and away from the rotation center 3, and a lifting and lowering mechanism 96 for positioning the rotary mechanism 82 and the slide mechanism 95 by lifting and lowering the rotary mechanism 82 and the slide mechanism 95 in a vertical direction. The lifting and lowering mechanism 96 corresponds to support means (support columns 14, 14, . . . , etc. in the first embodiment).

In this embodiment, one set of two pelvis-fixing means 73, 73 are arranged in an inverted V shape in a plan view. The outer shape of each pelvis-fixing means 73 is a substantially rectangular parallelepiped (substantially quadratic prism) having an appropriate thickness with a plane of a rectangle, a square, or the like, and an abutment surface to be pressed against the height position of the ilium of the user H is formed of a soft material. The thickness of the pelvis-fixing means 73 is generally set to about 30 mm. Note that, the outer shape of the pelvis-fixing means 73, 73 is not limited to a substantially rectangular parallelepiped, and can be appropriately selected and adopted from various publicly known outer shapes. Specific examples of the publicly known outer shapes include a substantially cylindrical shape, a substantially elliptical cylindrical shape, and a curved plate-shaped body. Further, each pelvis-fixing means 73 may have a structure that can be separated into some portions. For example, the above-mentioned front surface may be formed of a vertical or horizontal arrangement of at least two cylinders or prismatic bodies.

As described above, although this embodiment adopts a configuration using one set of at least two pelvis-fixing means 73, 73 arranged in an inverted V shape in a plan view, this embodiment is not limited thereto. For example, as shown in the first embodiment, it may also be possible to adopt a configuration in which the pelvis-fixing means is pressed against the height position of the ilium of the user H from a front side or a back side, or a configuration in which pelvis-fixing means having a similar outer shape and size are arranged on front and back sides of the user H and sandwich the height position of the ilium of the user H from the front and back sides. In the case of the latter configuration, the pelvis-fixing means on the back side newly requires means for supporting the pelvis-fixing means, and for example, a configuration similar to that of the rotary mechanism support means 74 or the like may be set on the backward side of the user H. Further, the pelvis-fixing means 73, 73 in this embodiment may be arranged in left-right symmetry when viewed from the user H, besides the arrangement having an inverted V shape in a plan view.

In the following, each mechanism (82, 95, 96) is described with reference to FIGS. 24A to 26. The rotary mechanism 82 illustrated in FIGS. 24A and 24B mainly includes a rail 83 having an arc shape in a plan view, and a traveling body 84 that is a plate-shaped body having a rectangular shape in a plan view. The traveling body 84 includes two pairs of pulleys 85, 85; 85, 85 provided on a lower surface thereof in one end portion in a length direction of the traveling body 84 and in a portion close to the one end portion, and a guide section 92 being provided on the other end side of the traveling body 84. Both ends of the rail 83 are respectively provided with stoppers 86R, 86L for regulating the traveling of the traveling body 84. The length direction of the traveling body 84 is matched with the radial direction of the rail 83, and the two pairs of pulleys 85, 85; 85, 85 are provided in an end portion outward in the radial direction and in a portion close to the end portion. The two pairs of pulleys 85, 85; 85, 85 are respectively arranged so as to sandwich the rail 83 respectively from an outer peripheral side and an inner peripheral side. Thus, the traveling body 84 can travel along the rail 83 and collide with any one of the stopper 86R and the stopper 86L at both ends to stop. That is, the clockwise rotation and the counterclockwise rotation of the pelvis-fixing means 73, 73 are regulated (stopped) at a position denoted by reference numeral 73' of FIG. 24B. The pulleys 85, 85 on the inner peripheral side can respectively move along elongated holes 84*b*, 84*b* formed in the traveling body 84 diagonally with respect to the radial direction of the rail 83. Then, the traveling body 84 is allowed to travel smoothly along the rail 83 by pressing and fixing the pulleys 85, 85 against the inner peripheral side of the rail 83 along the elongated holes 84b, 84b. The shape and material of the rail 83 are not particularly limited as long as the rail 83 is curved in an arc shape with the rotation center 3 being the center. Preferably, a cross section in a radial direction of an outer periphery and an inner periphery of the rail 83 is formed into, for example, a substantially semi-circular shape, a substantially semi-oval shape, or the like, and more preferably the rail is formed so as to be brought into close contact with an inner surface of a concave portion on the outer periphery of each pulley 85. Further, a pulley formed of a material such as a metal, a hard plastic, rubber, wood, or ceramics can be used as each pulley 85. As a specific example of the hard plastic, there is given "MC Nylon" (registered trademark) (manufactured by Quadrant Polypenco Japan Ltd.).

Further, the rotary mechanism 82 includes braking means 87R, 87L that respectively apply a braking force to the traveling body 84 in portions close to both end portions of the rail 83. The braking means 87R, 87L include stays 88R, 88L respectively fixed to portions close to the center of a bottom plate 74*j* of a housing 74*a* , rocking levers 89R, 89L capable of being respectively rocked about support shafts 891R, 891L (respectively arranged in portions closer to the stoppers 86R, 86L than to the stays 88R, 88L) provided similarly on the bottom plate 74*j* , and springs 90R, 90L serving as elastic bodies connected to the stays 88R, 88L and substantially intermediate portions of the rocking levers 89R, 89L. The springs 90R, 90L each include connecting members at both ends. The tip ends of the respective rocking levers 89R, 89L are generally arranged so as to get into the lower side of the rail 83.

A protrusion 84*a* is provided on a lower surface of an intermediate region of the traveling body 84. The protrusion 84*a* is configured to move in the vicinity of an inner peripheral side of the rail 83 so as to draw an arc that is concentric to the inner periphery when the traveling body 84 travels. When the traveling body 84 travels toward any end portion of the rail 83, the protrusion 84*a* collides with the rocking lever 89R or 89L at a rotation angle 01 from the center of the rail 83 and rotates the rocking lever 89R or 89L toward an end portion (see reference numeral 89R' of FIG. 24B. Thus, the spring 90R or 90L is expanded, and the traveling body 84 reaches any of the stoppers 86R and 86L at both ends of the rail to stop. The traveling body 84 receives an urging force (braking force) in a direction opposite to the traveling direction while being retained at that stop position. In FIGS. 24A and 24B, an angle range (braking angle range) in which the braking force is received is denoted by 03. Accordingly, in the braking angle range θ3, as the traveling body 84 approaches the stopper 86R or 86L, the braking force which the spring 90R or 90L applies to the traveling body 84 increases in inverse proportion to the approaching distance. Herein, the rotation angle θ1 is generally set to about 40° , and the braking angle range θ3 can be set to about 10° (rotation angle from the center of the rail 83 to the stoppers 86R, 86L at both ends can be generally set to about) 50° . Thus, the injuries and accidents caused by the excessive stretching of a human body by the excessive rotary motion can be prevented by providing the stoppers 86R, 86L and setting the braking angle range θ3. Note that, the rotary mechanism 82 may include load adjusting means (not shown) capable of adjusting a load to be applied to the traveling body 84 during the traveling of the traveling body 84. Means similar to the load adjusting means in the first embodiment can be used as the load adjusting means.

The slide mechanism 95 illustrated in FIGS. 25A and 25B includes, as main components, the guide section 92 having a square tube shape with a rectangular cross section provided in the traveling body 84, and a movable body 91 having a plate shape with a rectangular shape in a plan view and including a stopper 91*b* at one end and pelvis-fixing means fixing section 91*a* for supporting and fixing the pelvis-fixing means 73, 73 at the other end. In this embodiment, as described above, the guide section 92 serving as a part of the slide mechanism 95 is included in the rotary mechanism 82.

Two pairs of guide members 93, 93: 93, 93 respectively including guide grooves 93*a*, 93*a*having a V-shaped cross section opposed to each other in a direction orthogonal to an opening direction of the guide section 92 are fixed to both sides in a width direction of an inside of the guide section 92. The movable body 91 can slide and move in the opening direction with both edges thereof being respectively fitted in the opposed guide grooves 93*a*, 93*a*; 93*a*, 93*a*. Note that, although FIGS. 25A and 25B illustrate a configuration of the two pairs of the guide members 93, 93; 93, 93, the configuration is not limited thereto. It is only required that at least a pair of guide members be arranged along the slide movement direction of the movable body 91 so as not to hinder the slide movement of the movable body 91. In this case, it is preferred that cross sections of both edges in the width direction of the movable body 91 be formed into, for example, an arc shape swelling to an outer side (in FIGS. 25A and 25B, round bars 911, 911 are respectively fixed to both edges of the movable body 91 along a length direction of the movable body 91 by welding) so as to reduce the contact resistance with respect to the respective guide grooves 93*a*, 93*a*. A member formed of a material such as a metal, a hard plastic, wood, or ceramics can be used as the guide member 93. As a specific example of the hard plastic, there is given MC Nylon (registered trademark) (manufactured by Quadrant Polypenco Japan Ltd.).

Further, when the movable body 91 slides and moves toward the rotation center 3, the stopper 91*b* abuts against end surfaces on a forward side of the pair of the guide members 93, 93 on a forward side of the guide section 92 so as to suppress the further slide movement of the movable body 91. On the other hand, when the movable body 91 slides and moves in a direction away from the rotation center 3, an end surface on a forward side of the pelvis-fixing means fixing section 91*a* abuts against end surfaces on a backward side of the pair of the guide members 93, 93 on a backward side of the guide section 92 so as to suppress the slide movement of the movable body 91. Note that, a frame 761 including a pole support table 76 fixed to an upper surface thereof is fixed to an upper end portion of the pelvis-fixing means fixing section 91*a* by welding.

A plurality of concave holes 91*c* , 91*c* , . . . are arranged in a regular manner at a predetermined interval in an intermediate region of the movable body 91 along a length direction of the movable body 91. The respective concave holes 91*c* may or may not pass through the movable body 41 in a thickness direction thereof. Further, serial numbers starting from 1 are indicated on diagonally upper left sides of the respective concave holes 91*c* in a plan view of the movable body 91 so as to correspond to the respective concave holes 91*c*. Note that, the indication position of each number is not limited to the above-mentioned example as long as each number is indicated correspondingly in the vicinity of the concave hole 91*c*.

On the other hand, a through-hole is formed through an upper surface of an intermediate region of the guide section 92 close to the pelvis-fixing means fixing section 91*a*, and an index plunger 94 is fixed so as to pass through the through-hole. The index plunger 94 has a configuration in which, when a knob at an upper end of the index plunger 94 is pulled up against an urging force of a spring in the index plunger 94, a protrusion protruding from a lower end of the index plunger 94 is accommodated therein, and the protrusion protrudes from the lower end portion when the knob is released to return to the original position. In general, the protrusion at the lower end of the index plunger 94 is engaged with any concave hole 91c of the movable body 91 so as to regulate the slide movement of the movable body 91. When the user H pulls up the knob of the index plunger 94, the protrusion retracts into the index plunger 94, and the engagement of the protrusion with respect to the concave hole 91*c* of the movable body 91 is cancelled, with the result that the movable body 91 can slide and move. The slide movement possible range of the movable body 91 depends on the interval of the concave hole 91*c*positioned at the outermost end of the plurality of concave holes 91*c* provided in the movable body 91 (see reference symbol L2 of FIG. 25A).

Further, a viewing window 92*a* passing through the guide section 92 in a thickness direction thereof is provided on a diagonally upper left side of the index plunger 94 in an upper surface of the guide section 92. The user H can confirm one of the serial numbers respectively corresponding to the concave holes 91*c* that are seen through the viewing window 92*a* when the user looks through the viewing window 92*a* (FIG. 22). Thus, the user H can recognize what number of the plurality of arranged concave holes 91*c* of the movable body 91 the protrusion of the index plunger 94 is engaged with, and consequently, the user H can recognize the position of the pelvis-fixing means 73, 73 with respect to the user H.

Bearings 97*a* , 97*a* and shaft support sections 97*b* , 97*b* that respectively support rotation shafts (not shown) fitted in inner races of the bearings 97*a* , 97*a* are fixed to a bottom plate of the guide section 92. By arranging a combination of the bearing 97*a* and the shaft support section 97*b* , an end portion of the movable body 91 on the pelvis-fixing means fixing section 91*a* side is prevented from being warped due to the weight of the movable body 91 or, if not warped, is prevented from becoming lower relative to an end portion of the movable body 91 on the stopper 91*b* side. Note that, a rotary wheel having the same function as that of the bearing 97*a* can be substituted for the bearing 97*a*.

The pole support table 76 has a plate shape including a plane having a substantially trapezoidal shape and has cut-away regions 76*a* , 76*b* respectively formed on a forward side and on a backward side. The cut-away region 76*a* is formed into a substantially rectangular shape from an edge of the pole support table 76 on a forward side to a backward side (user H), and the knob of the index plunger 94 and the viewing window 92*a* are exposed from the cut-away region 76*a* . Thus, the user H can operate the index plunger 94 so as to align the pelvis-fixing means 73, 73 with the height position of the ilium of the user H before training. Further, the cut-away region 76*b* is formed so that abutment surfaces of the pelvis-fixing means 73, 73 are exposed therefrom in a plan view.

Two sets of three cylindrical poles 75*a*, 75*a*, 75*a*; 75*a*, 75*a*, 75*a* are provided as upper body support sections at an equal interval along two edges of an upper surface of the pole support table 76 so as to be opposed to each other with respect to the cut-away region 76*a*, and two poles 75*b*, 75*b* are provided on the right and left sides of a center region of the pole support table 76 close to the cut-away region 76*b*. Each pole 75*b* is relatively longer than the pole 75*a* and has a shape bent in the middle. Three poles 75*a*, 75*a*, 75*a*, and one pole 75*b* are provided on each of the right and left sides as the upper body support sections as described above so that the user H can select whether to place both the elbows on the pole support table 76 and grip or put the hands on the respective poles 75*a*, 75*a* on the right and left sides positioned so as to be matched with the wrists of the user H or to grip or put the hands on the respective poles 75*b*, 75*b* during the training (see FIGS. 27A and 27B). Preferably, the user H grips the respective poles 75*a*, 75*a* (or 75*b*, 75*b*) positioned in left-right symmetry when viewed from the user H. Thus, the user H grips the poles 75*a*, 75*a* or the poles 75*b*, 75*b* with both the hands as illustrated in FIGS. 27A and 27B while pressing one set of the pelvis-fixing means 73, 73 against the height position of the ilium of the user H from a forward side, thereby fixing the rectangle ABCD of the upper body as illustrated in FIG. 1 so as not to deform the rectangle ABCD, and suppressing the deviation of the center axis of the body of the user H from the rotation center 3 during the rotary motion of the upper body including the pelvis (lower abdomen and waist). Accordingly, more effective muscle training of a predetermined part can be performed.

The lifting and lowering mechanism 96 illustrated in FIG. 26 has the following configuration. Opposing mounting bases 101, 99 are respectively fixed to a flange 74*c* and a flange 77*h* respectively fixed to a lower surface of the housing 74*a* and an upper surface of the base 77. A gas spring 98 is connected between the mounting bases 101, 99 through connecting members 102, 100. Coming-in and going-out of a rod of the as spring 98 are performed by stepping on a lifting and lowering pedal 79 provided so as to protrude diagonally upward from the mounting base 99. The gas spring 98 lifts and lowers the rotary mechanism 82 and the slide mechanism 95, and the housing 74*a* for accommodating the mechanisms 82, 95. Note that, for example, a pneumatic cylinder, a hydraulic cylinder, a ratchet, or an electric actuator may be substituted for the gas spring 98. Further, for example, a foot switch or manually operable switches may be substituted for the lifting and lowering pedal 79. The switches in the latter case can be provided at appropriate positions inside or outside of the housing 74*a* , for example. Further, the lifting and lowering mechanism 96 can be separately provided with a publicly known braking system and a publicly known stopper for safety in view of the case of the failure of the gas spring 98 and the damages to the mounting bases 101, 99 and the connecting members 102, 100.

Further, an inner cylinder section 74*d* is downwardly fixed to the flange 74*c* so as to cover the mounting base 101, the connecting member 102, and the as spring 98. Connecting sections 105*a* and 106*a* are fixed to an outer peripheral surface of the inner cylinder section 74*d* at two different positions in a length direction of the inner cylinder section 74*d* by welding. Sliders 105 and 106 are mounted respectively on the connecting sections 105*a* and 106*a*.

A guide rail support section 107 is erected vertically from an upper surface of the base 77 on a forward side of the inner cylinder section 74*d* . A guide rail 104 is mounted on a surface of the support section 107 on the inner cylinder section 74*d* side vertically through a guide rail mounting member 104*a* . The two sliders 105 and 106 are respectively engaged with the guide rail 104. The two sliders 105 and 106 are connected to the connecting sections 105*a* and 106*a* fixed to the inner cylinder section 74*d* by welding. Thus, the inner cylinder section 74*d* is configured to be guided by the guide rail 104 so as to be lifted and lowered due to the coming-in and going-out of the rod of the as spring 98. Accordingly, the user H can move up and down (lift and lower) the pelvis-fixing means 73, 73 to the height position of the ilium of the user H in accordance with the body height of the user H by operating the lifting and lowering pedal 79.

The lifting and lowering mechanism 96 including the inner cylinder section 74*d* and the guide rail support section 107 is covered with a forward-side cover 74*f* and a backward-side cover 74*e* from a front-back direction of the lifting and lowering mechanism 96. Both the covers 74*f* and 74*e* are fixed to both side surfaces of the guide rail support section 107 so that respective joint regions in a substantially vertical direction of the covers 74*f* and 74*e* are joined to each other. Consequently, the inner cylinder section 74*d* can be lifted and lowered with respect to the forward-side cover 74*f* and the backward-side cover 74*e*.

As illustrated in FIGS. 20 and 23 the base 77 has a structure including an outer frame 77*a* having a substantially U shape in a plan view, a top plate 77*b* mounted on an upper end portion of the outer frame 77*a* , and reinforcing members 77*c* provided on a lower surface of the top plate 77*b* . The outer frame 77*a* has a substantially circular cross section. Further, leg sections 77*e*, 77*e* , . . . are mounted on a lower end of the outer frame 77*a* at five different positions in view of the balance of the center of gravity and the weight of the training apparatus 72 of this embodiment, and the like. Each leg section 77*e* has a publicly known function capable of adjusting the height thereof, and can adjust the horizontal balance at a time of the installment of the training apparatus 72 of this embodiment. Two of the reinforcing members 77*c* are fixed by welding to the top plate 77*b* in parallel with a front-back direction of the base 77, and the remaining one reinforcing member 77*c* is fixed by welding to the top plate 77*b* and opposed inner surfaces of the outer frame 77*a* together with the two reinforcing members 77*c* , 77*c* in a width direction of the base 77 on a backward side thereof.

The support shaft 811 having a shaft center matched with the rotation center 3 is erected vertically from a center region on an upper surface of the top plate 77*b* . In the upper end portion of the support shafts 811, the rotator section 81 having an outer shape of a substantially rectangular parallelepiped, in which the lengths of longitudinal and lateral sides of a cross section in a horizontal direction are different, is mounted rotatably about the rotation center 3 so that an upper part and a lower part thereof are sandwiched between flanges 811*a* , 811*b* (see the arrow denoted by reference symbol R of FIG. 23). When the user H starts training through use of the training apparatus 72 of this embodiment, the user H can obtain the stability of the lower body and can also contract the abdominal muscle group easily when contracting the adductor muscle by interposing the rotator section 81 between the knees before holding both the feet in contact with the flat top plate 77*b* of the base 77 in a pigeon-toed state. Then, the user H can rotate the upper body including the pelvis (lower abdomen and waist) about the rotation center 3 more reliably so as not to deform the rectangle ABCD (see FIG. 1) of the upper body by gripping the above-mentioned right and left poles 75*a* , 75*a* (or 75*b* , 75*b*) while pressing the pelvis-fixing means 73, 73 against the height position of the ilium of the user H, with the result that the muscle training of the area surrounding the trunk can be performed more effectively. Further, setting the rotator section 81 of a substantially rectangular parallelepiped to be rotatable has an advantage in that the user H can select any one of two widths (the above-mentioned lengths of the longitudinal and lateral sides) of the rotator section 81 to be sandwiched between the knees, depending on the body height and the age and sex of the user H. Note that, in this embodiment, although the rotator section 81 is formed into a substantially rectangular parallelepiped, the outer shape of the rotator section 81 is not limited thereto.

Further, a bar-shaped body 80 is arranged in a direction orthogonal to the front-back direction in the center region on the upper surface of the top plate 77*b* . The total length of the bar-shaped body 80 can be set appropriately. The bar-shaped body 80 is fixed to an upper end portion of a support piece 80*a* protruding from a slit 77*f* formed between the support shaft 811 and the lifting and lowering mechanism 96. A lower end portion of the support piece 80*a* is fixed to an upper surface of a slide plate 80*b* capable of sliding and moving between a pair of jaw-shaped rails 77*d* , 77*d* provided in parallel with each other along both edges of the slit 77*f* on a lower surface of the top plate 77*b* . Thus, the bar-shaped body 80 can move in the front-back direction in a range of the length of the slit 77*f* while maintaining the direction orthogonal to the front-back direction (see reference symbol L1 of FIG. 23).

Appropriate indications for calling the attention of the user H so that the user H can turn both the feet inwardly into a pigeon-toed state can be provided respectively in right and left regions positioned so as to interpose the support shaft 811 therebetween at the center of the upper surface of the top plate 77*b* . Further, in order to prevent the user H from slipping the foot during the training, for example, publicly known slip-proof treatment such as the setting of a slip-proof rubber mat or a slip-proof sheet in the right and left regions of the top plate 77*b* , the application of a slip-proof coating to those regions, or the formation of unevenness such as knurling in those regions can be performed. An area to be subjected to the slip-proof treatment can be determined appropriately, and for example, the entire surface of the top plate 77*b* may be subjected to the slip-proof treatment. Further, the above-mentioned indication for calling the attention of the user H can also be provided on an uneven surface or a surface subjected to the slip-proof treatment of the top plate 77*b*.

The user H slides and moves the bar-shaped body 80 in accordance with the size of the feet of the user H as needed, and place forward regions of both the feet on the bar-shaped body 80 while holding the heels in contact with the base 77 so that the user H can perform training with the toes raised. The user H can perform muscle training of the area surrounding the trunk more effectively by adopting such a use method.

As described above, in the training apparatus of the present invention, the user who is in predetermined standing posture while causing the center axis of the body to substantially match with the rotation center of the apparatus presses the pelvis-fixing means against the height position of the ilium from the front side or the back side or from the front and back sides of the user and repeats the movement of rotating the upper body including the pelvis (lower abdomen and waist) so as not to deform the upper body (see FIG. 1) while keeping the center axis of the body so that the center axis is not deviated from the rotation center. Thus, the user can subject not only the trunk such as the transverse abdominal muscle, the rectus abdominal muscle, the external abdominal oblique muscle, the internal abdominal oblique muscle, the iliopsoas muscle (psoas major muscle, psoas minor muscle, iliac muscle), the lumbar quadrate muscle, the lumbar iliocostal muscle, the multifidus muscle, the erector muscle of spine, the iliac muscle, and the gluteus medius muscle but also the muscles surrounding the area from the pelvis to the hip joint to contraction such as concentric contraction, eccentric contraction, and isometric contraction easily in a short period of time. This results in strengthening the trunk and enhancing the stability thereof, increasing an abdominal pressure to slim down (reduce the size of) the area around the waist, and also adjusting posture.

Note that, the training apparatus of the present invention is not limited to the above-mentioned embodiments, and the improvement and modification not departing from the spirit of the present invention, such as the mutual application of the slide movement mechanism and the lifting and lowering mechanism for the pelvis-fixing means in the first to fourth embodiments, shall be included in the scope of the present invention. Each of the above-mentioned embodiments is used under the condition that the user is in predetermined standing posture. However, it is only required that the training apparatus of the present invention be configured so that the user can perform the movement of rotating the upper body including the pelvis so as not to deform the upper body. Therefore, the training apparatus of the present invention may have a configuration, for example, in which the user takes posture of standing with the knees.

Further, it is only required that the rotary mechanism support means in the first embodiment to the fourth embodiment be configured so as to align the pelvis-fixing means with the height position of the ilium of the user by moving the pelvis-fixing means in the front-hack direction and in the up-and-down direction while directly or indirectly supporting the pelvis-fixing means. The rotary mechanism support means can also be configured so as to be suspended from, for example, a ceiling or a beam (it does not matter whether or not the training apparatus of the present invention includes those members).

INDUSTRIAL APPLICABILITY

The training apparatus of the present invention can be used effectively for not only the purpose of the muscle training as described above but also the purpose of rehabilitation and shape-up exercise.

REFERENCE SIGNS LIST

1 . . . training apparatus of present invention (first embodiment), 2 . . . rotary mechanism support means, 3 . . . rotation center, 4 . . . pelvis-fixing means, 41, 42 . . . pole (upper body support section), 5 . . . rotary mechanism, 6 . . . rotary table, 6*a* . . . cut-out region, 7 . . . rotation table support means, 7*a* . . . end surface, 71 . . . lid, 72 . . . housing, 8 . . . opening, 8*a* . . . accommodating chamber of circumferential portion of rotary table, 9 . . . grip, 10 . . . load adjusting means, 11 . . . base, 12 . . . inclined foot rest, 12*a* . . . foot direction indication, 13 . . . overturning prevention device, 14 . . . support column, 14*a* . . . inner cylinder, 14*b* . . . outer cylinder, 15 . . . lifting and lowering lever, 16 . . . shaft, 17 . . . sheathed pipe, 18 . . . locking section, 19 . . . guide rail, 191 . . . stopper, 20, 22, 24 . . . bearing, 20*a* , 22*a* , 24*a* . . . shaft, 21, 23, 25 . . . shaft support section, 27 . . . braking means, 28 . . . protruding part, 29 . . . braking cylinder, 30 . . . rod section, 31 . . . knob, 32 . . . case, 33 . . . upper portion in case, 34 . . . pin receiving section, 35 . . . inner cylinder, 36 . . . spring, 37 . . . shaft support section, 38 . . . load bearing, 44 . . . training apparatus of present invention (second embodiment), 45 . . . rotary mechanism support means, 47, 51 . . . connecting section, 48, 49 . . . arm, 52 . . . base, 53 . . . rotary table, 55 . . . training apparatus of present invention (third embodiment), 56 . . . rotary mechanism support means, 57 . . . pelvis-fixing means, 571 . . . band-shaped fastening member, 58 . . . stay, 59 . . . guide section, 591 . . . knob, 60 . . . support column, 61 . . . wire, 62 . . . pair of pulleys, 63 . . . pulley, 64 . . . weight, 65 . . . base, 66 . . . arc-shaped long hole, 67 . . . rotary mechanism accommodating chamber, 68 . . . horizontal member 69 . . . rotary shaft, 70 . . . shaft support section, 72 . . . training apparatus of present invention (fourth embodiment), 73 . . . pelvis-fixing means, 74 . . . rotary mechanism support means, 74*a* . . . housing, 74*b* . . . opening, 74*c* . . . flange, 74*d* . . . inner cylinder section, 74*e* . . . backward-side cover, 74*f* . . . forward-side cover, 74*k* . . . rotary mechanism accommodating chamber, 75*a* , 75*b* . . . pole (upper body support section), 76 . . . pole support table, 761 . . . frame, 77 . . . base, 77*a* . . . outer frame, 77*b* . . . top plate, 77*c* . . . reinforcing member, 77*d* . . . jaw-shaped rail, 77*e* . . . leg section, 77*f* . . . slit, 77*h* . . . flange, 79 . . . lifting and lowering pedal, 80 . . . bar-shaped body, 80*a* . . . support piece, 80*b* . . . slide plate, 81 . . . rotator section, 811 . . . support shaft, 811*a* , 811*b* . . . rotator section fixing flange, 82 . . . rotary mechanism, 83 . . . arc-shaped rail, 84 . . . traveling body, 84*a* . . . protrusion, 84*b* . . . elongated holes, 85 . . . pulley, 86R, 86L . . . stopper, 87R, 87L . . . braking means, 88R, 88L . . . stay, 89R, 89L . . . rocking lever, 891R, 891L . . . rotary shaft, 90R, 90L . . . spring with connecting member, 91 . . . movable body, 911 . . . round bar, 91*a* . . . pelvis-fixing means fixing section, 91*b* . . . stopper, 91*c* . . . concave hole, 92 . . . guide section, 92*a* . . . viewing window, 93 . . . guide member, 93*a* . . . guide groove, 94 . . . index plunger, 95 . . . slide mechanism, 96 . . . lifting and lowering mechanism, 97*a* . . . bearing, 97*b* . . . shaft support section, 98 . . . gas spring, 99, 101 . . . mounting base, 100, 102 . . . connecting member, 104 . . . guide rail, 104*a* . . . guide rail mounting member, 105, 106 . . . slider, 105*a*, 106*a* . . . connecting section, 107 . . . guide rail support section, θ1 . . . rotation angle (angle from position before rotation in rotary mechanism until application of braking starts), θ2 . . . rotation limit angle, θ3 . . . braking angle range

The invention claimed is:

1. A training apparatus, comprising:

a support base having a rotation center configured and arranged to be substantially matched with a center axis of a body of a user when the user is in a standing posture thereon, the support base configured to remain stationary during use of the training apparatus;

a pelvis resting member movably mounted with respect to the support base, and capable of moving relative to the rotation center, the pelvis resting member configured to be contacted by and to support a user's midsection; and a rotary mechanism support assembly for supporting the pelvis resting member , said rotary mechanism support assembly comprising:

a rotary mechanism configured so as to rotate the pelvis resting member about the rotation center; and an adjustable height support structure capable of aligning the rotary mechanism by moving the rotary mechanism vertically in parallel with the rotation center, wherein the rotary mechanism comprises:

an arc-shaped rail with the rotation center being at a central portion thereof;

a traveling body configured to travel along the arc-shaped rail; and a guide section for supporting a movable body including the pelvis resting member in an end portion on a rotation center side of the traveling body, so that the movable body is capable of sliding and moving.

2. A training apparatus according to claim 1, wherein the pelvis resting member is arranged so as to be pressed against the user's midsection at a height position of an ilium of the user from a front side or a back side of the user, or wherein the pelvis resting member is arranged on each of front and back sides of the user so as to sandwich the user's midsection at a height position of the ilium of the user from the front and back sides.

3. A training apparatus according to claim 2, wherein the pelvis resting member comprises at least one set of pelvis resting components arranged in an inverted V shape in a plan view or in left-right symmetry.

4. A training apparatus according to claim 1, wherein the pelvis resting member is configured and arranged to contact a front side of the user and further comprises, in an upper part thereof, an upper body support section for regulating a motion of an upper body of the user.

5. A training apparatus according to claim 1, wherein the rotary mechanism comprises:

a rotary table; and a rotary table support structure for rotatably supporting the rotary table, and wherein the rotary table has a substantially horseshoe shape in a plan view in which a cut-out region is formed, the cut-out region extending from a part of an outer periphery of a substantially disc-shaped body in a plan view to approach a part of the outer periphery on an opposite side thereto in a diameter direction by passing through a center.

6. A training apparatus according to claim 1, wherein the rotary mechanism comprises:

a rotary table; and a rotary table support structure for rotatably supporting the rotary table, and wherein the rotary table has a donut shape in a plan view in which an insertion hole is formed in a center region of the rotary table in a manner that the insertion hole passes through a front surface and a back surface of the rotary table so as to be substantially concentric with the center region and the body of the user is capable of entering the insertion hole.

7. A training apparatus according to claim 1, further comprising:

a support shaft erected from a portion in a vicinity of feet of the user taking the standing posture, the support shaft including a shaft center matched with the rotation center; and a rotator section formed so as to be sandwiched between knees of the user, the rotator section being provided in an upper end portion of the support shaft so as to rotate about the rotation center.

8. A training apparatus according to claim 1, further comprising, in a portion configured to be disposed in a vicinity of feet of the user taking the standing posture, an inclined surface having a rising slope from a heel to a toe of the user and an indication for calling attention of the user so that the user places both legs into a pigeon-toed state, the indication being provided on the inclined surface.

9. A training apparatus according to claim 1, further comprising a bar-shaped body configured to be disposed in front of feet of the user, the bar-shaped body further being configured to be disposed substantially in parallel with a forehead surface of the user and enabling the user to place forward regions of both feet of the user on the bar-shaped body, the bar-shaped body being arranged so as to move in a front-back direction between the rotation center and the rotary mechanism support assembly.

10. A training apparatus comprising:

a support base having a rotation center which is configured and arranged to be substantially matched with a center axis of a body of a user when the user is in a standing posture thereon;

a pelvis resting member movably mounted with respect to the support base, and capable of moving relative to the rotation center; and a rotary mechanism support assembly for supporting the pelvis resting member, said rotary mechanism support assembly comprising:

a rotary mechanism configured so as to rotate the pelvis resting member about the rotation center; and an adjustable height support structure capable of aligning the rotary mechanism by moving the rotary mechanism vertically in parallel with the rotation center;

wherein the rotary mechanism comprises:

an arc-shaped rail with the rotation center being at a central portion thereof;

a traveling body configured to travel along the arc-shaped rail; and a guide section for supporting a movable body including the pelvis resting member in an end portion on a rotation center side of the traveling body, so that the movable body is capable of sliding and moving.

11. A training apparatus according to claim 10, wherein the arc-shaped rail comprises, in each of two end portions thereof, a stopper for regulating traveling of the traveling body.

12. A training apparatus according to claim 10, wherein the rotary mechanism comprises braking devices for applying a braking force to the traveling body respectively in portions close to the end portions of the arc-shaped rail.

13. A training apparatus according to claim 12, wherein each of the braking devices comprises an elastic body, and wherein an urging force of the elastic body, which increases in inverse proportion to an approaching distance of the traveling body to a stopper, serves as the braking force.

14. A training apparatus according to claim 10, wherein the rotary mechanism comprises a load adjusting mechanism capable of adjusting a load to be applied to the traveling body during traveling of the traveling body.

15. A training apparatus according to claim 10, wherein the guide section comprises a pair of guide members respectively arranged at each of two ends thereof in a width direction of the guide section, and wherein the movable body is capable of sliding and moving in a radial direction of the arc-shaped rail with both edges thereof being respectively fitted in guide grooves provided in surfaces opposed to each other of the pair of guide members.

16. A training apparatus according to claim 15, wherein each of the guide grooves is formed into a substantially V shape in a cross section taken in a direction orthogonal to the sliding and moving direction, and wherein both the edges of the movable body are formed into an arc shape swelling to an outer side in a cross section taken in the direction orthogonal to the sliding and moving direction.

17. A training apparatus according to claim 16, wherein the guide grooves are formed of a plastic material.

18. A training apparatus according to claim 15, wherein the guide members are formed of a plastic material.

19. A training apparatus according to claim 10, further comprising a support shaft erected from a portion in a vicinity of feet of the user taking the standing posture, the support shaft including a shaft center matched with the rotation center; and a rotator section formed so as to be sandwiched between knees of the user, the rotator section being provided in an upper end portion of the support shaft so as to rotate about the rotation center.

20. A training apparatus according to claim 10, further comprising, in a portion configured to be disposed in a vicinity of feet of the user taking the standing posture, an inclined surface having a rising slope from a heel to a toe of the user and an indication for calling attention of the user so that the user places both legs into a pigeon-toed state, the indication being provided on the inclined surface.

21. A training apparatus according to claim 10, further comprising a bar-shaped body configured to be disposed in front of feet of the user, the bar-shaped body further being configured to be disposed substantially in parallel with a forehead surface of the user and enabling the user to place forward regions of both feet of the user on the bar-shaped body, the bar-shaped body being arranged so as to move in a front-back direction between the rotation center and the rotary mechanism support assembly.

* * * * *